US006631979B2

(12) United States Patent
Lebens et al.

(10) Patent No.: US 6,631,979 B2
(45) Date of Patent: Oct. 14, 2003

(54) THERMAL ACTUATOR WITH OPTIMIZED HEATER LENGTH

(75) Inventors: John A. Lebens, Rush, NY (US); Antonio Cabal, Webster, NY (US); David S. Ross, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/050,993

(22) Filed: Jan. 17, 2002

(65) Prior Publication Data

US 2003/0137560 A1 Jul. 24, 2003

(51) Int. Cl.[7] ..... B41J 2/14; B41J 2/04; B41J 2/05

(52) U.S. Cl. ..... 347/54; 347/48; 347/61; 347/65

(58) Field of Search ..... 347/20, 40, 41, 347/44, 48, 54, 56, 61–65, 68; 216/27; 29/25.35

(56) References Cited

U.S. PATENT DOCUMENTS

| | | | | |
|---|---|---|---|---|
| 3,747,120 | A | 7/1973 | Stemme | |
| 3,946,398 | A | 3/1976 | Kyser et al. | 346/1 |
| 4,296,421 | A | 10/1981 | Hara et al. | |
| 5,599,695 | A | 2/1997 | Pease et al. | |
| 5,771,882 | A | 6/1998 | Psaros et al. | |
| 5,781,331 | A | 7/1998 | Carr et al. | |
| 5,796,152 | A | 8/1998 | Carr et al. | |
| 5,902,648 | A | 5/1999 | Naka et al. | 427/558 |
| 6,067,797 | A | 5/2000 | Silverbrook | 60/528 |
| 6,087,638 | A | 7/2000 | Silverbrook | 219/540 |
| 6,180,427 | B1 | 1/2001 | Silverbrook | 438/21 |
| 6,239,821 | B1 | 5/2001 | Silverbrook | 347/54 |
| 6,243,113 | B1 | 6/2001 | Silverbrook | 347/54 |
| 6,254,793 | B1 | 7/2001 | Silverbrook | 216/27 |
| 6,274,056 | B1 | 8/2001 | Silverbrook | 216/27 |

FOREIGN PATENT DOCUMENTS

| | | |
|---|---|---|
| EP | 1085219 | 3/2001 |
| EP | 1112848 | 7/2001 |
| JP | 20330543 | 1/1990 |
| JP | 02 030543 | 4/1990 |

OTHER PUBLICATIONS

US 2001/038403 Silverbrook Nov. 8, 2001.

*Primary Examiner*—Judy Nguyen
*Assistant Examiner*—An H. Do
(74) *Attorney, Agent, or Firm*—William R. Zimmerli

(57) ABSTRACT

An apparatus for a thermal actuator for a micromechanical device, especially a liquid drop emitter is disclosed. The disclosed thermal actuator includes a base element and a cantilevered element extending from the base element a length L and normally residing at a first position before activation. The cantilevered element includes a layer constructed of an electrically resistive material, patterned to have a uniform resistor portion extending a length L, from the base element, wherein $0.3L \leqq L_H \leqq 0.7L$. The cantilevered element includes a second layer constructed of a dielectric material having a low coefficient of thermal expansion attached to the first layer. A pair of electrodes connected to the uniform resistor portion to apply an electrical pulse to cause resistive heating, resulting in a thermal expansion of the uniform resistor portion of the first layer relative to the second layer and deflection of the cantilevered element.

26 Claims, 15 Drawing Sheets

THERMAL ACTUATOR WITH OPTIMIZED HEATER LENGTH

FIELD OF THE INVENTION

The present invention relates generally to micro-electromechanical devices and, more particularly, to micro-electromechanical thermal actuators such as the type used in ink jet devices and other liquid drop emitters.

BACKGROUND OF THE INVENTION

Micro-electro mechanical systems (MEMS) are a relatively recent development. Such MEMS are being used as alternatives to conventional electro-mechanical devices as actuators, valves, and positioners. Micro-electromechanical devices are potentially low cost, due to use of microelectronic fabrication techniques. Novel applications are also being discovered due to the small size scale of MEMS devices.

Many potential applications of MEMS technology utilize thermal actuation to provide the motion needed in such devices. For example, many actuators, valves and positioners use thermal actuators for movement. In some applications the movement required is pulsed. For example, rapid displacement from a first position to a second, followed by restoration of the actuator to the first position, might be used to generate pressure pulses in a fluid or to advance a mechanism one unit of distance or rotation per actuation pulse. Drop-on-demand liquid drop emitters use discrete pressure pulses to eject discrete amounts of liquid from a nozzle.

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electroresistive heaters to generate vapor bubbles which cause drop emission, as is discussed by Hara et al., in U.S. Pat. No. 4,296,421.

Electroresistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezoelectrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro-analytic chemistry as disclosed by Pease et al., in U.S. Pat. No. 5,599,695, dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission is needed which can be used with a broad range of liquid formulations. Apparatus and methods are needed which combines the advantages of microelectronic fabrication used for thermal ink jet with the liquid composition latitude available to piezo-electro-mechanical devices.

A DOD ink jet device which uses a thermo-mechanical actuator was disclosed by T. Kitahara in JP 2,030,543, filed Jul. 21, 1988. The actuator is configured as a bi-layer cantilever moveable within an ink jet chamber. The beam is heated by a resistor causing it to bend due to a mismatch in thermal expansion of the layers. The free end of the beam moves to pressurize the ink at the nozzle causing drop emission. Recently, disclosures of a similar thermo-mechanical DOD ink jet configuration have been made by K. Silverbrook in U.S. Pat. Nos. 6,067,797; 6,087,638; 6,239,821 and 6,243,113. Methods of manufacturing thermo-mechanical ink jet devices using microelectronic processes have been disclosed by K. Silverbrook in U.S. Pat. Nos. 6,180,427; 6,254,793 and 6,274,056.

Thermo-mechanically actuated drop emitters are promising as low cost devices which can be mass produced using microelectronic materials and equipment and which allow operation with liquids that would be unreliable in a thermal ink jet device. However, operation of thermal actuator style drop emitters, at high drop repetition frequencies, requires careful attention to the effects of heat build-up. The drop generation event relies on creating a pressure impulse in the liquid at the nozzle. A significant rise in baseline temperature of the emitter device, and, especially, of the thermo-mechanical actuator itself, precludes system control of a portion of the available actuator displacement that can be achieved without exceeding maximum operating temperature limits of device materials and the working liquid itself. Apparatus and methods of operation for thermo-mechanical DOD emitters are needed which manage the effects of heat in the thermo-mechanical actuator so as to maximize the productivity of such devices.

A useful design for thermo-mechanical actuators is a cantilevered beam anchored at one end to the device structure with a free end that deflects perpendicular to the beam. The deflection is caused by setting up thermal expansion gradients in the beam in the perpendicular direction. Such expansion gradients may be caused by temperature gradients or by actual materials changes, layers, thru the beam. It is advantageous for pulsed thermal actuators to be able to establish the thermal expansion gradient quickly, and to dissipate it quickly as well, so that the actuator will restore to an initial position. Reduction of the input energy assists in restoration of the actuator by reducing the amount of waste heat energy that must be dissipated.

The repetition frequency of thermal actuations is important to the productivity of the devices that employ them. For example, the printing speed of a thermal actuator DOD ink jet printhead depends on the drop repetition frequency, which, in turn, depends on the time required to re-set the thermal actuator. Cantilevered element thermal actuators, which can be operated with reduced energy and at acceptable peak temperatures, are needed in order to build systems that operate at high frequency and can be fabricated using MEMS fabrication methods.

SUMMARY OF THE INVENTION

It is therefore an object of the present invention to provide a thermo-mechanical actuator which uses reduced input energy and which does not require excessive peak temperatures.

It is also an object of the present invention to provide a liquid drop emitter which is actuated by an energy efficient thermo-mechanical cantilever operating at peak temperatures that will not damage working liquids.

The foregoing and numerous other features, objects and advantages of the present invention will become readily apparent upon a review of the detailed description, claims and drawings set forth herein. These features, objects and advantages are accomplished by constructing a thermal actuator for a micro-electromechanical device comprising a base element and a cantilevered element extending from the base element a length L and normally residing at a first position before activation. The cantilevered element includes a first layer constructed of an electrically resistive material, such as titanium aluminide, patterned to have a uniform resistor portion extending a length $L_H$ from the base element, wherein $0.3L \leqq L_H \leqq 0.7L$. The cantilevered element includes a second layer constructed of a dielectric material having a low coefficient of thermal expansion attached to the first layer. A pair of electrodes connected to the uniform resistor portion to apply an electrical pulse to cause resistive heating, resulting in a thermal expansion of the uniform resistor portion of the first layer relative to the second layer and deflection of the cantilevered element to a second position, followed by restoration of the cantilevered element to the first position as heat transfers from the uniform resistor portion and the temperature decreases. The first layer preferably extends for substantially the full length of the cantilevered element and the uniform resistor portion is preferably formed by removing a central slot of this material from a partial length of the cantilevered element. Forming the uniform resistor portion to have a length $L_H$, where $0.3L<L_H<0.7L$, results in reduced energy requirements for operation while not causing excessive increases in operating temperatures.

The present invention is particularly useful as a thermal actuator for liquid drop emitters used as printheads for DOD ink jet printing. In this preferred embodiment the thermal actuator resides in a liquid-filled chamber that includes a nozzle for ejecting liquid. The thermal actuator includes a cantilevered element extending from a wall of the chamber and a free end residing in a first position proximate to the nozzle. Application of a heat pulse to the cantilevered element causes deflection of the free end forcing liquid from the nozzle.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides apparatus for a thermal actuator and a drop-on-demand liquid emission device. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide drop emitters based on thermo-mechanical actuators so as to energy efficiency and drop emission productivity.

Figure 1:
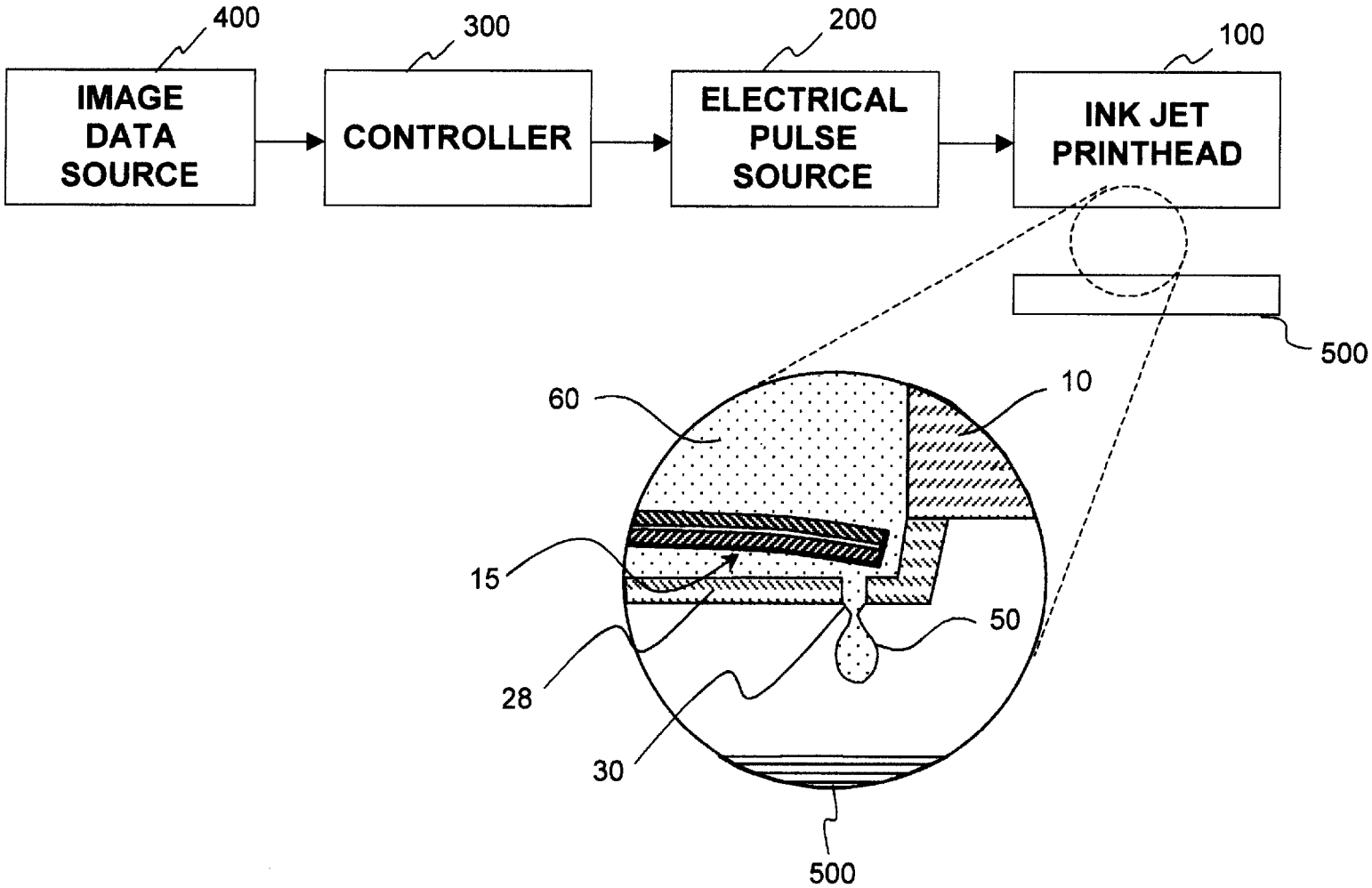
FIG. 1 is a schematic illustration of an ink jet system according to the present invention.

Turning first to FIG. 1, there is shown a schematic representation of an ink jet printing system which may use an apparatus and be operated according to the present invention. The system includes an image data source 400 which provides signals that are received by controller 300 as commands to print drops. Controller 300 outputs signals to a source of electrical pulses 200. Pulse source 200, in turn, generates an electrical voltage signal composed of electrical energy pulses which are applied to electrically resistive means associated with each thermo-mechanical actuator 15 within ink jet printhead 100. The electrical energy pulses cause a thermo-mechanical actuator 15 (herein after "thermal actuator") to rapidly bend, pressurizing ink 60 located at nozzle 30, and emitting an ink drop 50 which lands on receiver 500. The present invention causes the emission of drops having substantially the same volume and velocity, that is, having volume and velocity within +/−20% of a nominal value. Some drop emitters may emit a main drop and very small trailing drops, termed satellite drops. The present invention assumes that such satellite drops are considered part of the main drop emitted in serving the overall application purpose, e.g., for printing an image pixel or for micro dispensing an increment of fluid.

Figure 2:
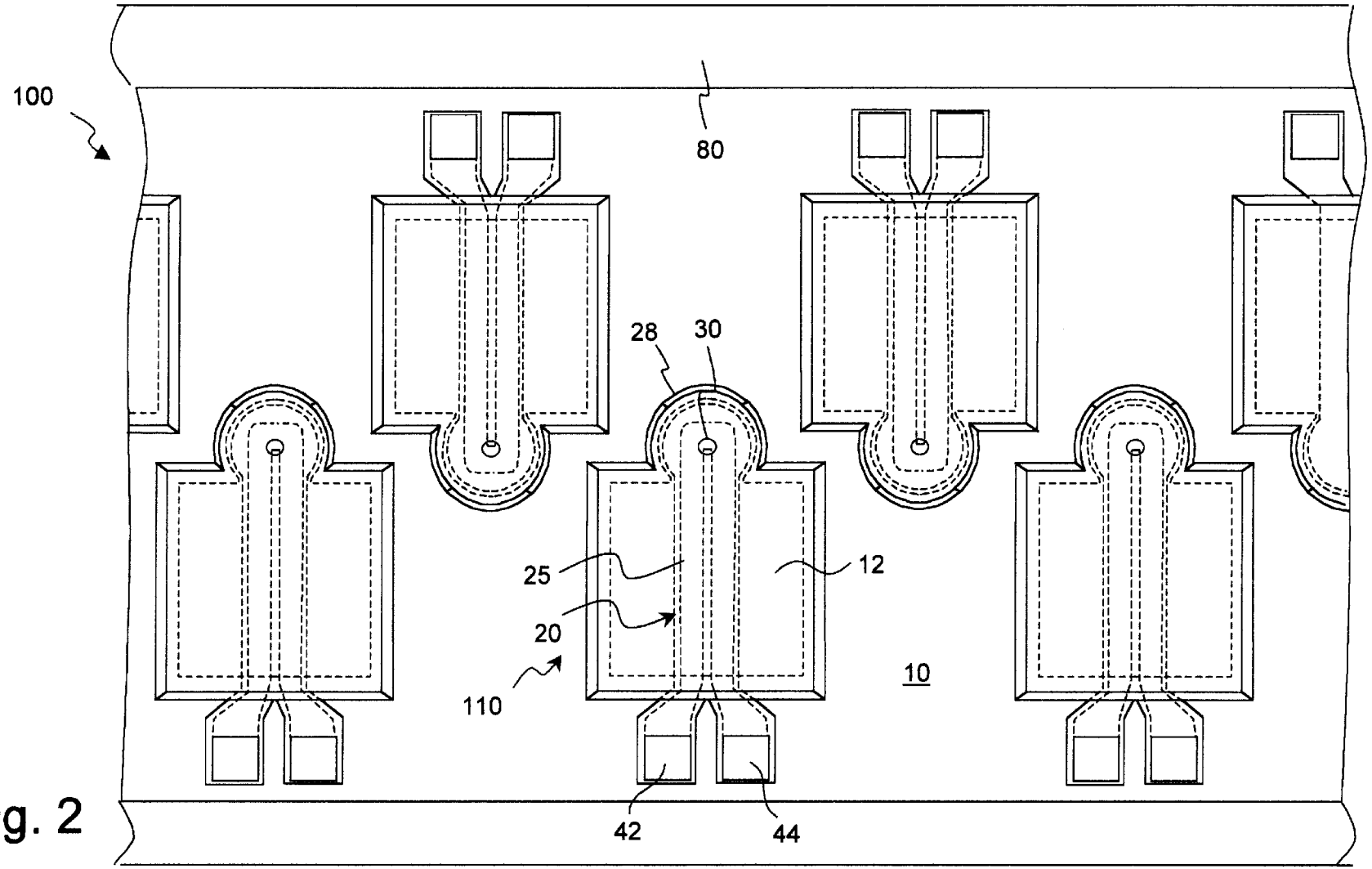
FIG. 2 is a plan view of an array of ink jet units or liquid drop emitter units according to the present invention.

FIG. 2 shows a plan view of a portion of ink jet printhead 100. An array of thermally actuated ink jet units 110 is shown having nozzles 30 centrally aligned, and ink chambers 12, interdigitated in two rows. The ink jet units 110 are formed on and in a substrate 10 using microelectronic fabrication methods. An example fabrication sequence which may be used to form drop emitters 110 is described in co-pending application Ser. No. 09/726,945 filed Nov. 30, 2000, for "Thermal Actuator", assigned to the assignee of the present invention.

Each drop emitter unit 10 has associated electrical lead contacts 42, 44 which are formed with, or are electrically connected to, a electrically uniform resistor portion 25, shown in phantom view in FIG. 2. In the illustrated embodiment, the uniform resistor portion 25 is formed in a deflector layer of the thermal actuator 15 and participates in the thermo-mechanical effects as will be described. Element 80 of the printhead 100 is a mounting structure which provides a mounting surface for microelectronic substrate 10 and other means for interconnecting the liquid supply, electrical signals, and mechanical interface features.

Figure 3A:
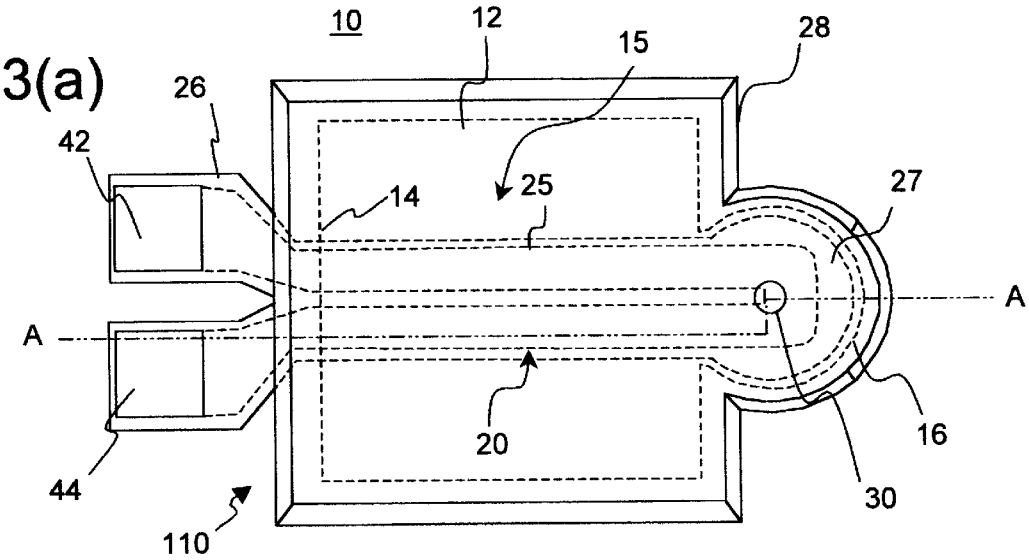
FIG. 3 is an enlarged plan view of an individual ink jet unit shown in FIG. 2.
Figure 3B:
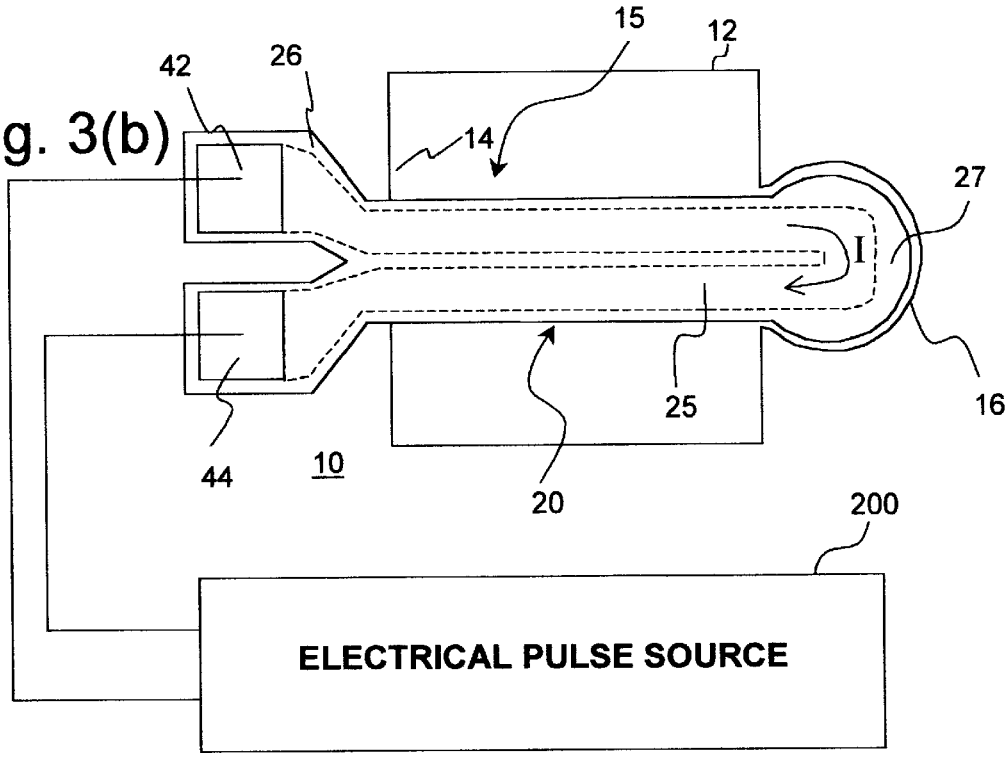

FIG. 3*a* illustrates a plan view of a single drop emitter unit 110 and a second plan view FIG. 3*b* with the liquid chamber cover 28, including nozzle 30, removed.

The thermal actuator 15, shown in phantom in FIG. 3*a* can be seen with solid lines in FIG. 3*b*. The cantilevered element 20 of thermal actuator 15 extends from edge 14 of liquid chamber 12 which is formed in substrate 10. Cantilevered element anchor portion 26 is bonded to substrate 10 and anchors the cantilever.

The cantilevered element 20 of the actuator has the shape of a paddle, an extended flat shaft ending with a disc of larger diameter than the shaft width. This shape is merely illustrative of cantilever actuators which can be used, many other shapes are applicable. The paddle shape aligns the nozzle 30 with the center of the cantilevered element free end portion 27. The fluid chamber 12 has a curved wall portion at 16 which conforms to the curvature of the free end portion 27, spaced away to provide clearance for the actuator movement.

FIG. 3*b* illustrates schematically the attachment of electrical pulse source 200 to the electrically resistive heater 25 at interconnect terminals 42 and 44. Voltage differences are applied to voltage terminals 42 and 44 to cause resistance heating via u-shaped resistor 25. This is generally indicated by an arrow showing a current 1. In the plan views of FIG. 3, the actuator free end portion 27 moves toward the viewer when pulsed and drops are emitted toward the viewer from the nozzle 30 in cover 28. This geometry of actuation and drop emission is called a "roof shooter" in many ink jet disclosures.

Figure 4A:
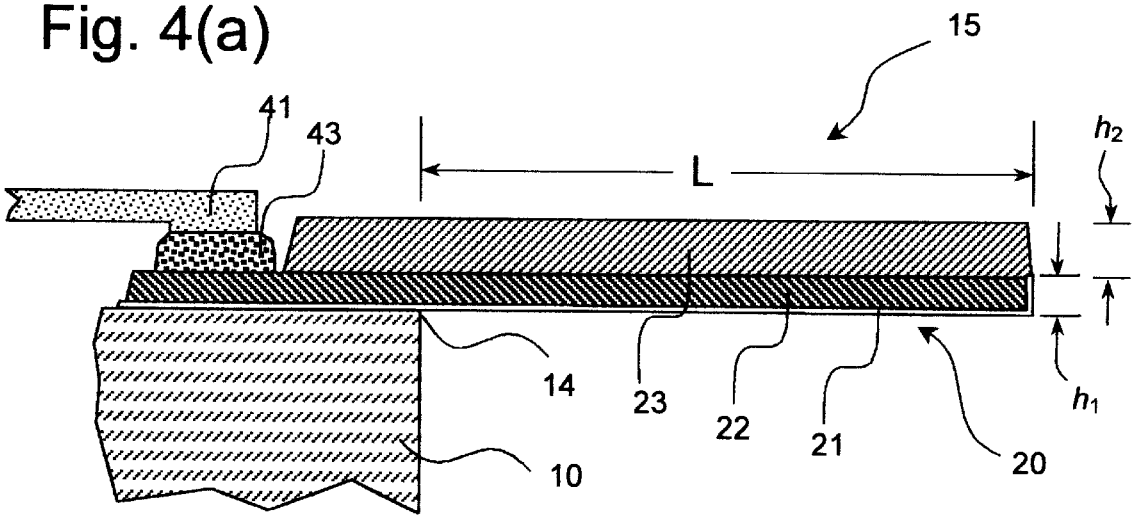
FIG. 4 is a side view illustrating the movement of a thermal actuator according to the present invention.
Figure 4B:
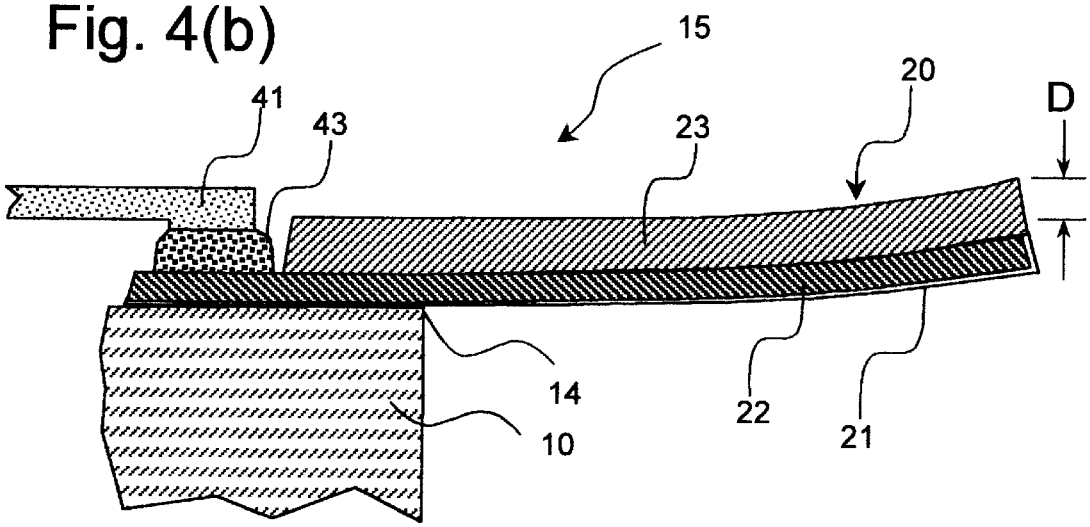

FIG. 4 illustrates in side view a cantilevered thermal actuator 15 according to a preferred embodiment of the present invention. In FIG. 4*a* the actuator is in a first position and in FIG. 4*b* it is shown deflected upward to a second position. Cantilevered element 20 extends a length L from an anchor location 14 of base element 10. The cantilevered element 20 is constructed of several layers. First layer 22 is the deflector layer which causes the upward deflection when it is thermally elongated with respect to other layers in the cantilevered element 20. It is constructed of an electrically resistive material, preferably intermetallic titanium aluminide, that has a large coefficient of thermal expansion. First layer 22 has a thickness of $h_1$.

The cantilevered element 20 also includes a second layer 23, attached to the first layer 22. The second layer 23 is constructed of a material having a low coefficient of thermal expansion, with respect to the material used to construct the first layer 22. The thickness of second layer 23 is chosen to provide the desired mechanical stiffness and to maximize the deflection of the cantilevered element for a given input of heat energy. Second layer 23 may also be a dielectric insulator to provide electrical insulation for a resistive heater element formed into the first layer. The second layer may be used to partially define an electroresistor formed as a portion of first layer 22. Second layer 23 has a thickness of $h_2$.

Second layer 23 may be composed of sub-layers, laminations of more than one material, so as to allow optimization of functions of heat flow management, electrical isolation, and strong bonding of the layers of the cantilevered element 20.

Passivation layer 21 shown in FIG. 4 is provided to protect the first layer 22 chemically and electrically. Such protection may not be needed for some applications of thermal actuators according to the present invention, in which case it may be deleted. Liquid drop emitters utilizing thermal actuators which are touched on one or more surfaces by the working liquid may require passivation layer 21 which is chemically and electrically inert to the working liquid.

A heat pulse is applied to first layer 22, causing it to rise in temperature and elongate. Second layer 23 does not elongate nearly as much because of its smaller coefficient of thermal expansion and the time required for heat to diffuse from first layer 22 into second layer 23. The difference in length between first layer 22 and the second layer 23 causes the cantilevered element 20 to bend upward as illustrated in FIG. 4*b*. When used as actuators in drop emitters, the bending response of the cantilevered element 20 must be rapid enough to sufficiently pressurize the liquid at the nozzle. Typically, electroresistive heating apparatus is adapted to apply heat pulses and an electrical pulse duration of less than 10 $\mu$secs. is used and, preferably, a duration less than 4 $\mu$secs.

Figure 5:
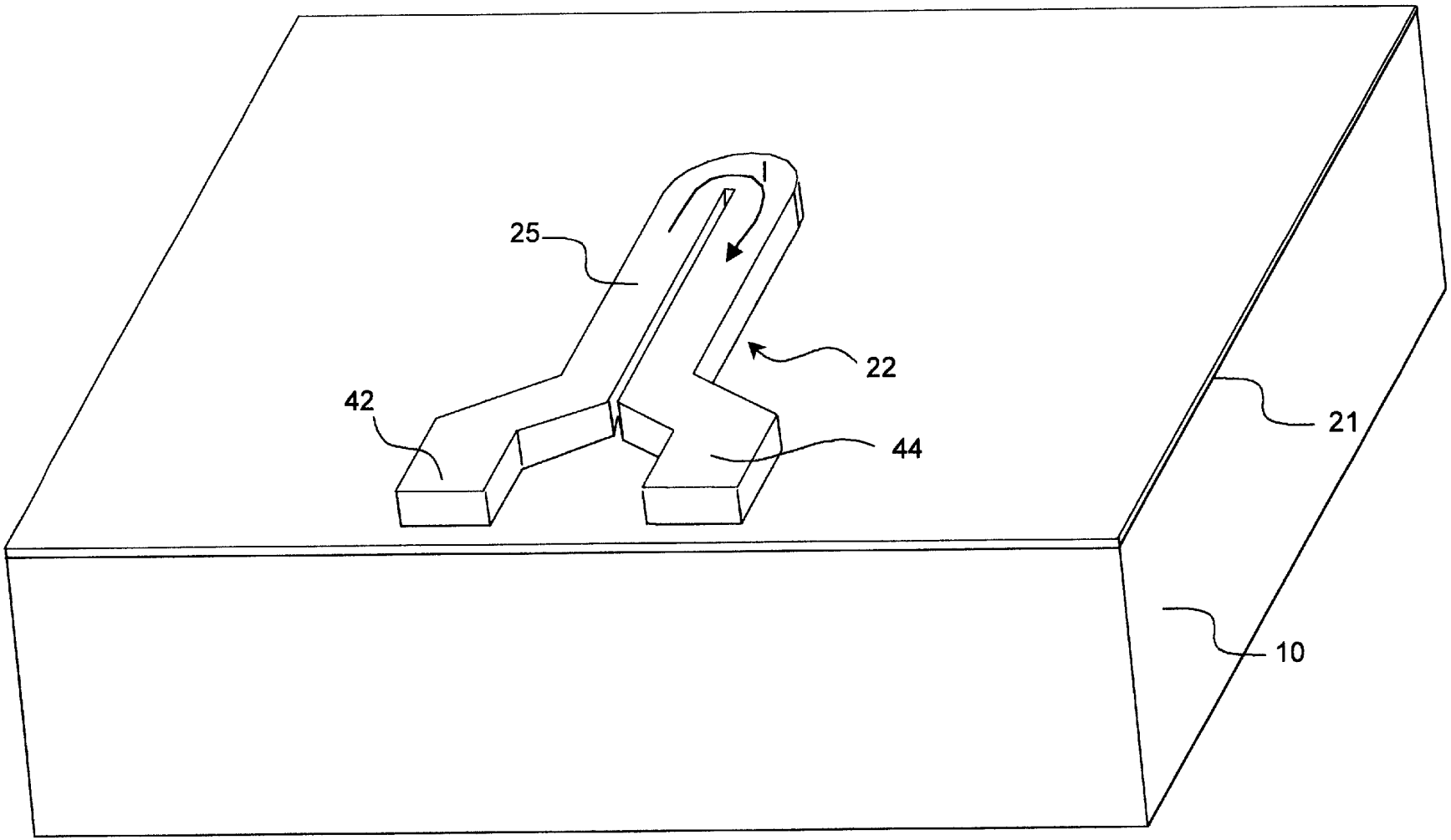
FIG. 5 is a perspective view of the early stages of a process suitable for constructing a thermal actuator according to the present invention wherein a first layer of the cantilevered element is formed.

FIGS. 5 through 9 illustrate fabrication processing steps for constructing a single liquid drop emitter according to some of the preferred embodiments of the present invention. For these embodiments the first layer 22 is constructed using an electrically resistive material, such as titanium aluminide, and a portion is patterned into a resistor for carrying electrical current, 1. FIG. 5 illustrates a first layer 22 of a cantilever in a first stage of fabrication. The illustrated structure is formed on a substrate 10, for example, single crystal silicon, by standard microelectronic deposition and patterning methods. A portion of substrate 10 will also serve as a base element from which cantilevered element extends. Deposition of intermetallic titanium aluminide may be carried out, for example, by RF or pulsed DC magnetron sputtering. An example deposition process that may be used for titanium aluminide is described in co-pending application Ser. No. 09/726,945 filed Nov. 30, 2000, for "Thermal Actuator", assigned to the assignee of the present invention.

First layer 22 is deposited with a thickness of $h_1$. A uniform resistor portion 25 is patterned in first layer 22 by removing a pattern of the layer material. The current path is indicated by an arrow and letter "I". Addressing electrical leads 42 and 44 are illustrated as being formed in the first layer 22 material as well. Leads 42, 44 may make contact with circuitry previously formed in base element substrate 10 or may be contacted externally by other standard electrical interconnection methods, such as tape automated bonding (TAB) or wire bonding. A passivation layer 21 is formed on substrate 10 before the deposition and patterning of the first layer 22 material. This passivation layer may be left under first layer 22 and other subsequent structures or removed in a subsequent patterning process.

Figure 6:
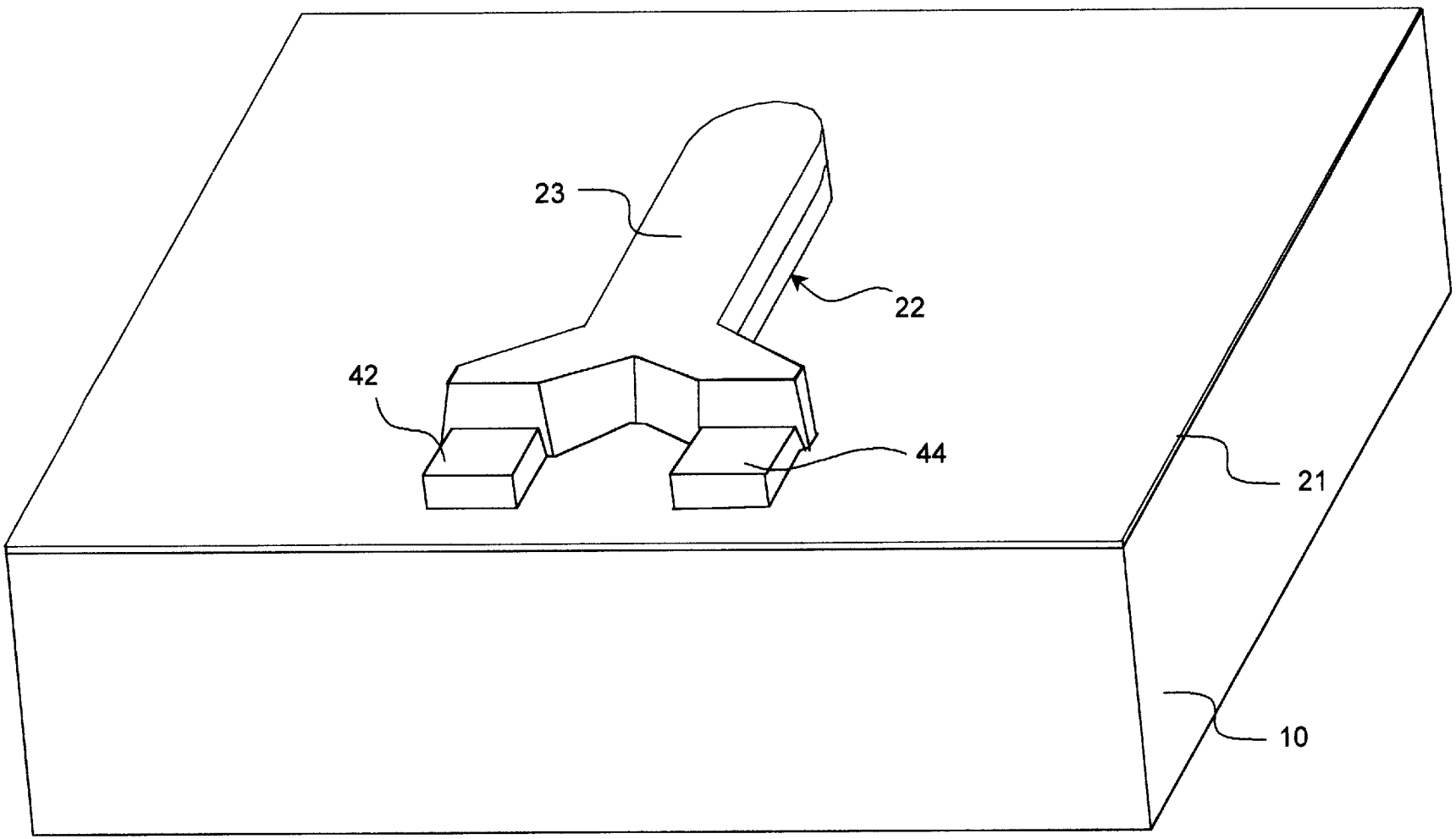
FIG. 6 is a perspective view of the next stages of the process illustrated in FIG. 5 wherein a second layer of the cantilevered element is formed.

FIG. 6 illustrates a second layer 23 having been deposited and patterned over the previously formed first layer 22 portion of the thermal actuator. A uniform resistor portion 25 (not shown in FIG. 6) was formed by removing electrically resistive material in the first layer 22 leaving a remaining resistor pattern. Second layer 23 is formed over the first layer 22 covering the remaining resistor pattern. Second layer 23 is deposited with a thickness of $h_2$. The second layer 23 material has low coefficient of thermal expansion compared to the material of first layer 22. For example, second layer 23 may be silicon dioxide, silicon nitride, aluminum oxide or some multi-layered lamination of these materials or the like.

Additional passivation materials may be applied at this stage over the second layer 23 for chemical and electrical protection. Also, the initial passivation layer 21 is patterned away from areas through which fluid will pass from openings to be etched in substrate 10.

Figure 7:
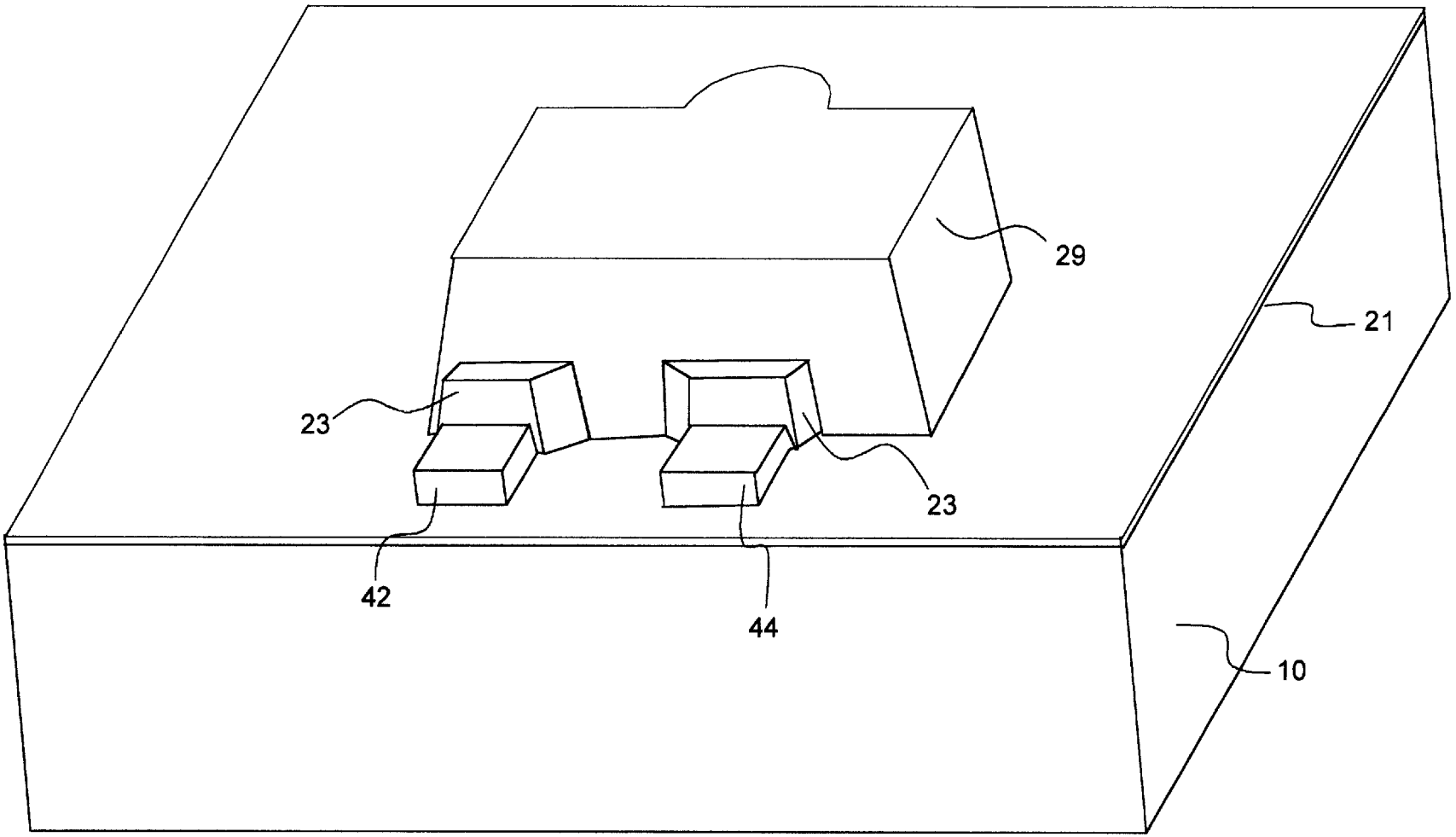
FIG. 7 is a perspective view of the next stages of the process illustrated in FIGS. 5 and 6 wherein a sacrificial layer in the shape of the liquid filling a chamber of a drop emitter according to the present invention is formed.

FIG. 7 shows the addition of a sacrificial layer 29 which is formed into the shape of the interior of a chamber of a liquid drop emitter. A suitable material for this purpose is polyimide. Polyimide is applied to the device substrate in sufficient depth to also planarize the surface which has the topography of the first 22 and second 23 layers as illustrated in FIG. 6. Any material which can be selectively removed with respect to the adjacent materials may be used to construct sacrificial structure 29.

Figure 8:
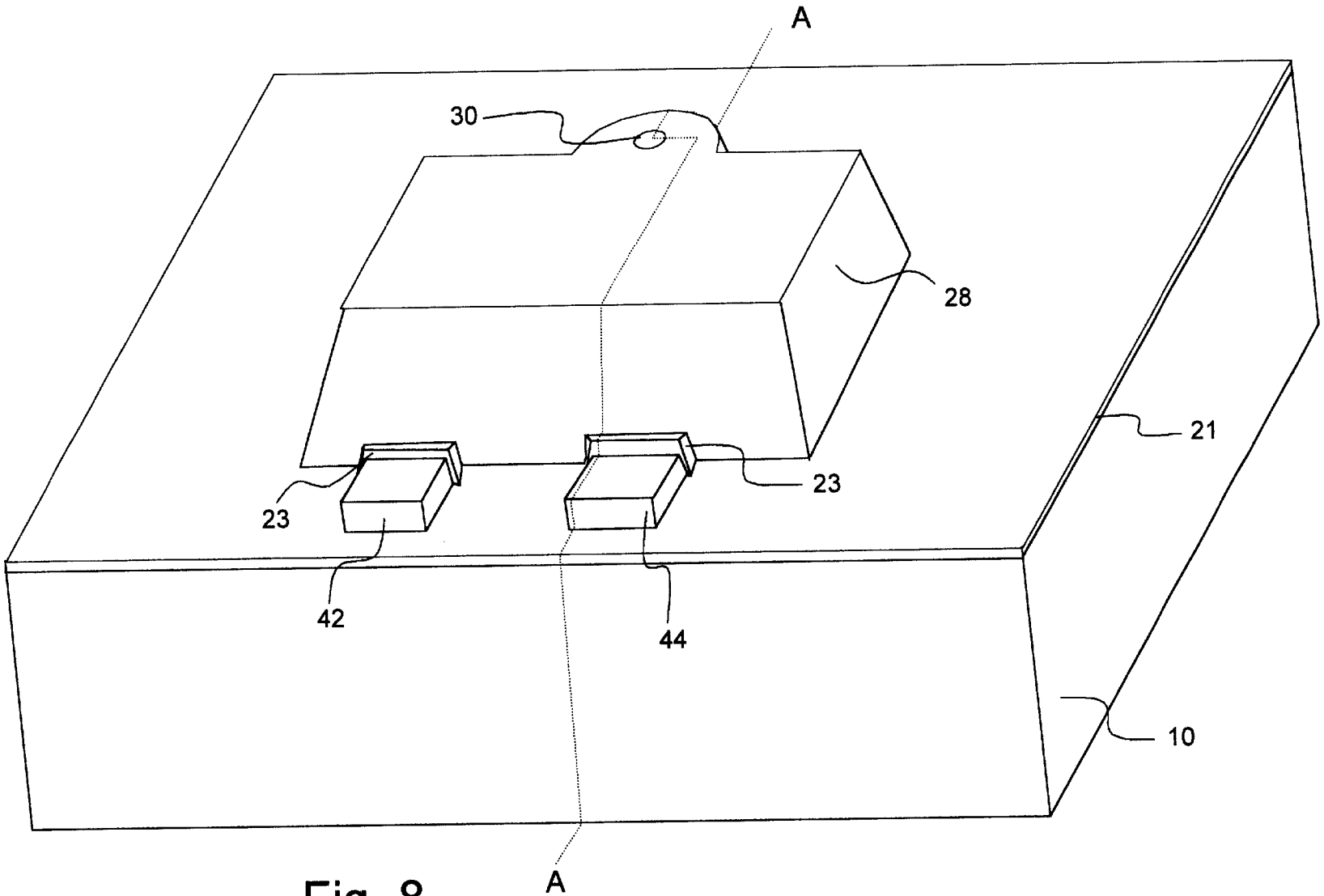
FIG. 8 is a perspective view of the next stages of the process illustrated in FIGS. 5–7 wherein a liquid chamber and nozzle of a drop emitter according to the present invention is formed.

FIG. 8 illustrates drop emitter liquid chamber walls and cover formed by depositing a conformal material, such as plasma deposited silicon oxide, nitride, or the like, over the sacrificial layer structure 29. This layer is patterned to form drop emitter chamber 28. Nozzle 30 is formed in the drop emitter chamber, communicating to the sacrificial material layer 29, which remains within the drop emitter chamber 28 at this stage of the fabrication sequence.

Figure 9:
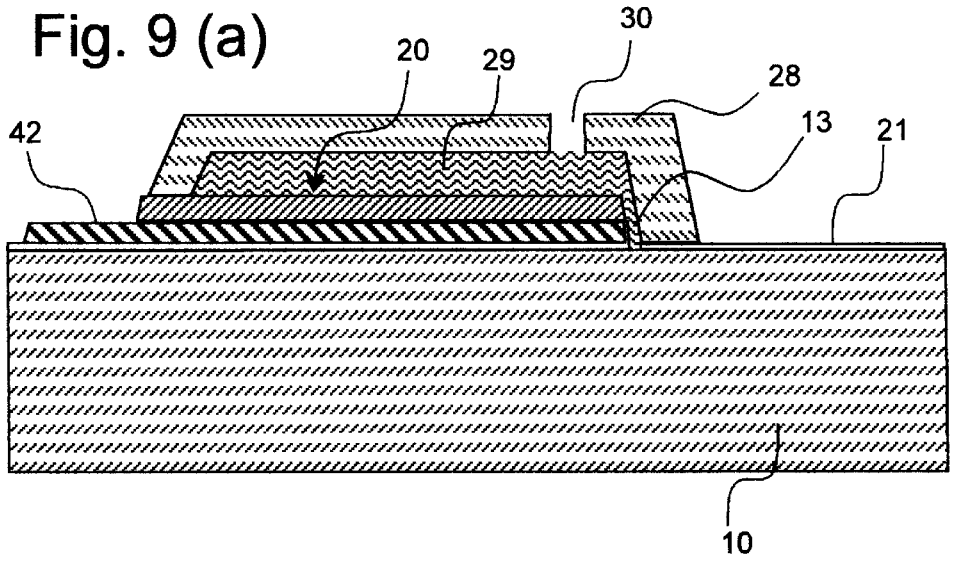
FIG. 9 is a side view of the final stages of the process illustrated in FIGS. 5–8 wherein a liquid supply pathway is formed and the sacrificial layer is removed to complete a liquid drop emitter according to the present invention.
Figure 9:
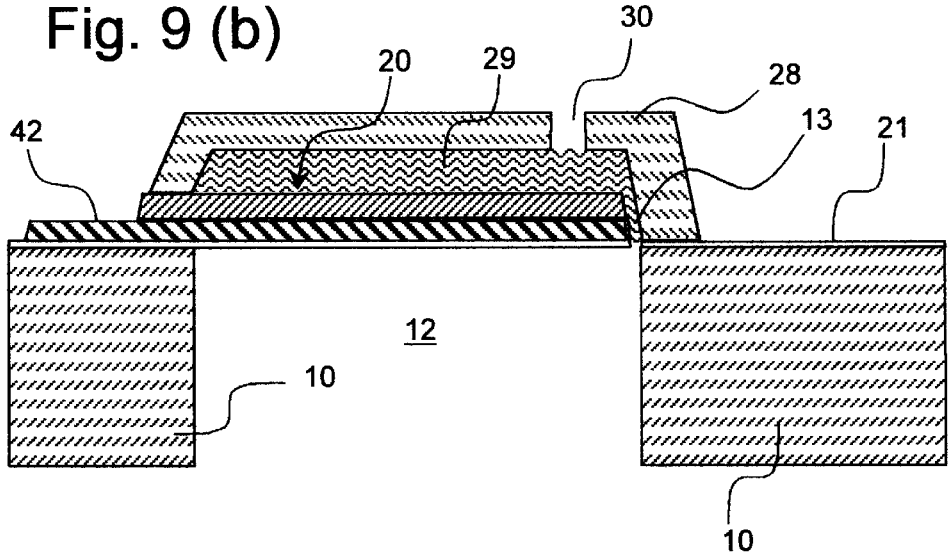
Figure 9:
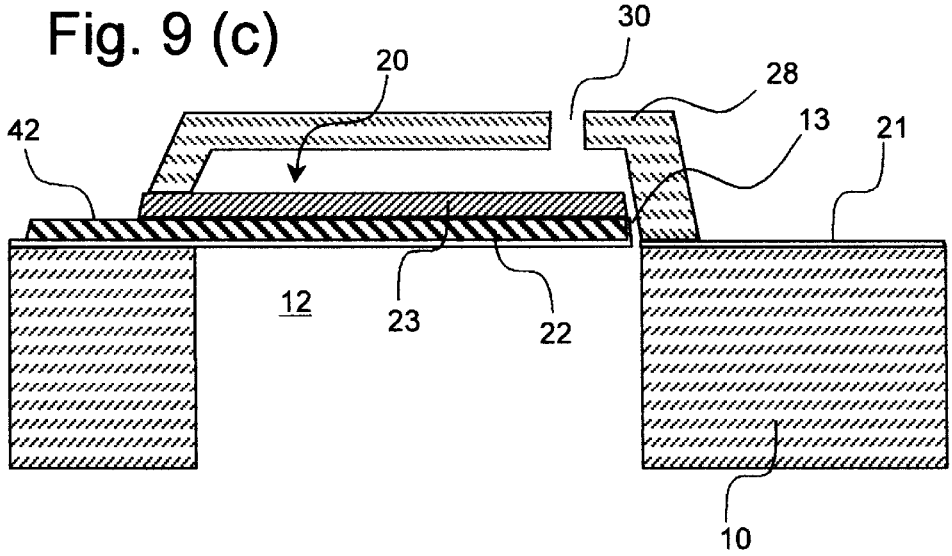

FIG. 9 shows a side view of the device through a section indicated as A—A in FIG. 8. In FIG. 9*a* the sacrificial layer 29 is enclosed within the drop emitter chamber walls 28 except for nozzle opening 30. Also illustrated in FIG. 9*a*, the substrate 10 is intact. Passivation layer 21 has been removed from the surface of substrate 10 in gap area 13 and around the periphery of the cantilevered element 20. The removal of layer 21 in these locations was done at a fabrication stage before the forming of sacrificial structure 29.

In FIG. 9*b*, substrate 10 is removed beneath the cantilever element 20 and the liquid chamber areas around and beside the cantilever element 20. The removal may be done by an anisotropic etching process such as reactive ion etching, or such as orientation dependent etching for the case where the substrate used is single crystal silicon. For constructing a thermal actuator alone, the sacrificial structure and liquid chamber steps are not needed and this step of etching away substrate 10 may be used to release the cantilevered element 20.

In FIG. 9*c* the sacrificial material layer 29 has been removed by dry etching using oxygen and fluorine sources. The etchant gasses enter via the nozzle 30 and from the newly opened fluid supply chamber area 12, etched previously from the backside of substrate 10. This step releases the cantilevered element 20 and completes the fabrication of a liquid drop emitter structure.

Figure 10:
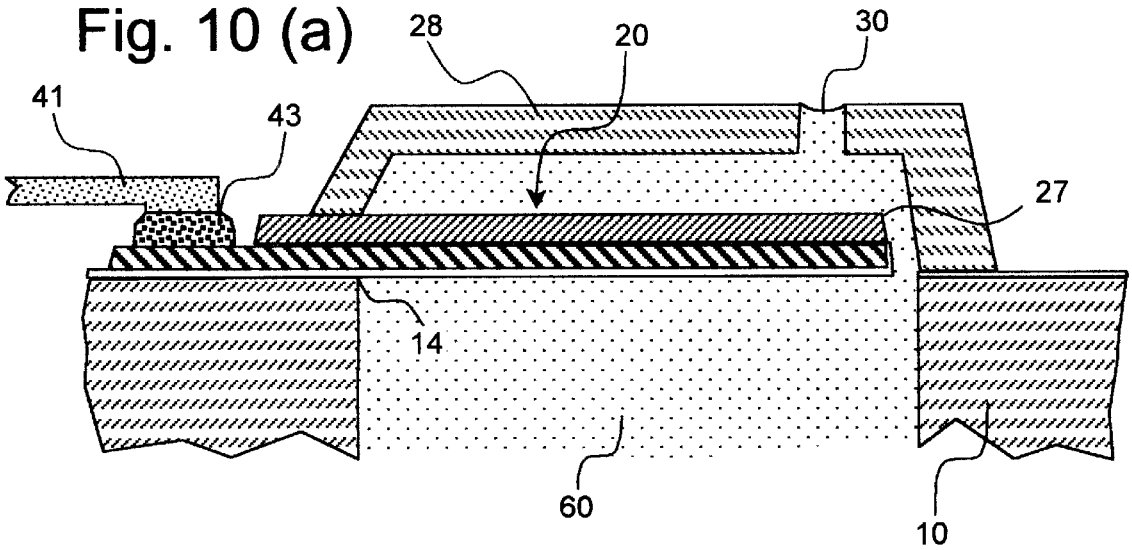
FIG. 10 is a side view illustrating the operation of a drop emitter according the present invention.
Figure 10:
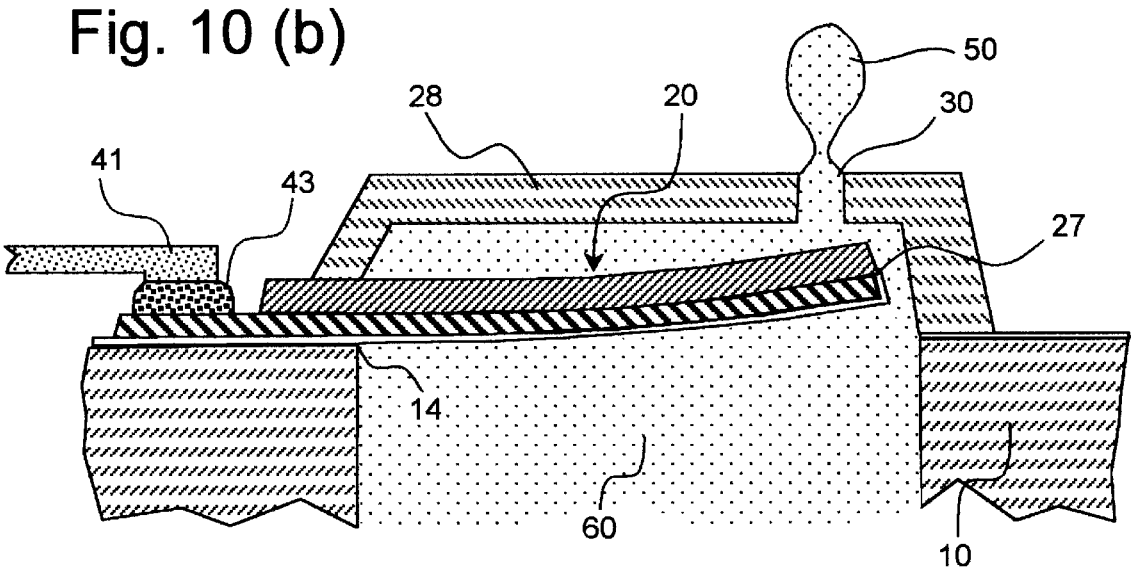

FIG. 10 illustrates a side view of a liquid drop emitter structure according to some preferred embodiments of the present invention. FIG. 10*a* shows the cantilevered element 20 in a first position proximate to nozzle 30. FIG. 10*b* illustrates the deflection of the free end 27 of the cantilevered element 20 towards nozzle 30. Rapid deflection of the cantilevered element to this second position pressurizes liquid 60 causing a drop 50 to be emitted.

In an operating emitter of the cantilevered element type illustrated, the quiescent first position may be a partially bent condition of the cantilevered element 20 rather than the horizontal condition illustrated FIG. 10*a*. The actuator may be bent upward or downward at room temperature because of internal stresses that remain after one or more microelectronic deposition or curing processes. The device may be operated at an elevated temperature for various purposes, including thermal management design and ink property control. If so, the first position may be as substantially bent as is illustrated in FIG. 10*b*.

For the purposes of the description of the present invention herein, the cantilevered element will be said to be quiescent or in its first position when the free end is not significantly changing in deflected position. For ease of understanding, the first position is depicted as horizontal in FIG. 4*a* and FIG. 10*a*. However, operation of thermal actuators about a bent first position are known and anticipated by the inventors of the present invention and are fully within the scope of the present inventions.

FIGS. 5 through 9 illustrate a preferred fabrication sequence. However, many other construction approaches may be followed using well known microelectronic fabrication processes and materials. For the purposes of the present invention, any fabrication approach which results in a cantilevered element including a first layer 22 and a second layer 23 may be followed. Further, in the illustrated sequence of FIGS. 5 through 9, the liquid chamber 28 and nozzle 30 of a liquid drop emitter were formed in situ on substrate 10. Alternatively a thermal actuator could be constructed separately and bonded to a liquid chamber component to form a liquid drop emitter.

Figure 11A:
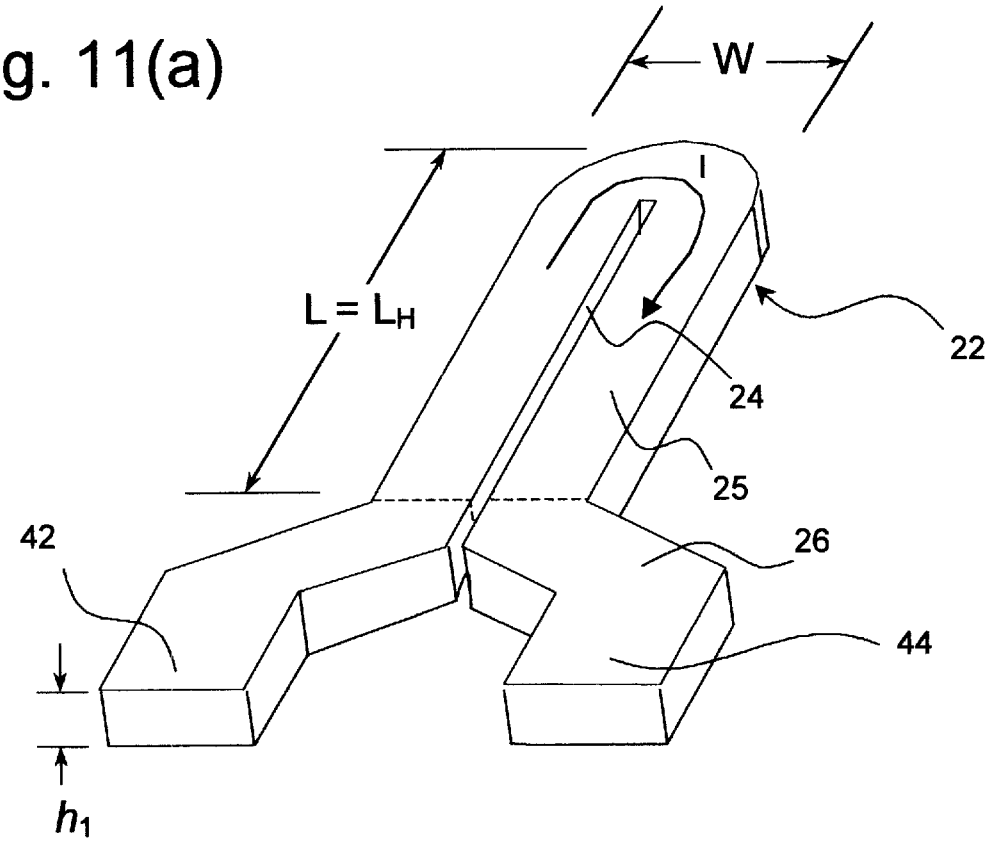
FIG. 11 is a perspective view of first layer designs to illustrate a preferred embodiment of the present invention.

The inventors of the present have discovered that the energy efficiency of a cantilevered thermal actuator can be increased by heating only a portion of the deflector layer, first layer 22. The electrically resistive material used to construct first layer 22 may be patterned to have a portion 25 of uniform resistance which extends for only part of the cantilevered element length L. FIG. 11 illustrates this concept. FIG. 11*a* illustrates a perspective view of patterned first layer 22 as previously illustrated in FIG. 5. The electrically resistive material of first layer 22 is patterned into a u-shaped resistor by removing a central slot 24 of material. In FIG. 11*a* the uniform resistor portion extends a length $L_H$ the full length of the cantilevered element extension length L, that is, $L_H$=L.

Figure 11B:
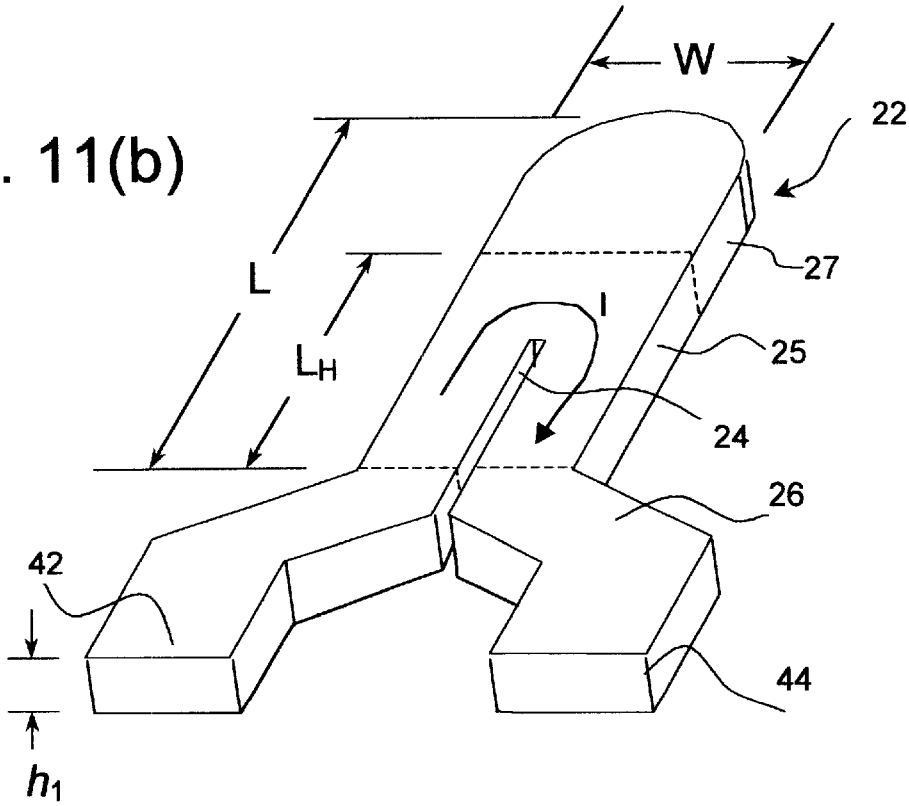

In FIG. 11*b* the first layer 22 is patterned to have a uniform resistor portion 25 which extends a shorter distance $L_H$ than the full cantilevered element extension L, that is, $L_H$<L. First layer 22 is illustrated as divided into three general portions by dotted lines: free end portion 27, uniform resistor portion 25, and anchored end portion 26. Electrical input pads 42 and 44 are formed in anchor end portion 26.

When operating a cantilevered element actuator having a first layer 22 design as illustrated in FIG. 11*b*, heating will initially occur in an approximately uniform fashion over the length $L_H$ in uniform resistor portion 25. First layer 22, in uniform resistor portion 25, will elongate with respect to second layer 23 (not shown in FIG. 11*b*) causing the cantilevered element to bend away from first layer 22. Free end portion 27 of first layer 22 will also be deflected since it is rigidly attached to uniform resistor portion 25. Free end portion 27 acts as a lever arm, further magnifying the amount of bending deflection which occurs in the directly heated uniform resistor portion 25. Significant input energy may be saved because of this magnification effect. A desired amount of actuator free end deflection, D, may be achieved with less input energy because only a fraction of the elongation layer is heated.

Figure 12:
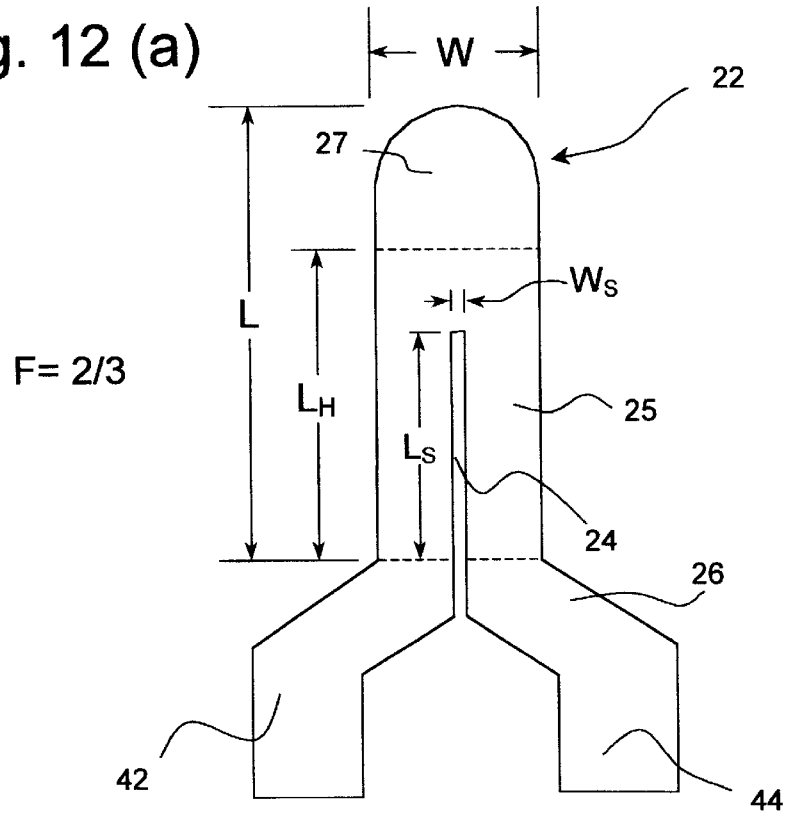
FIG. 12 is a plan view of first layer designs to illustrate a preferred embodiment of the present invention.
Figure 12:
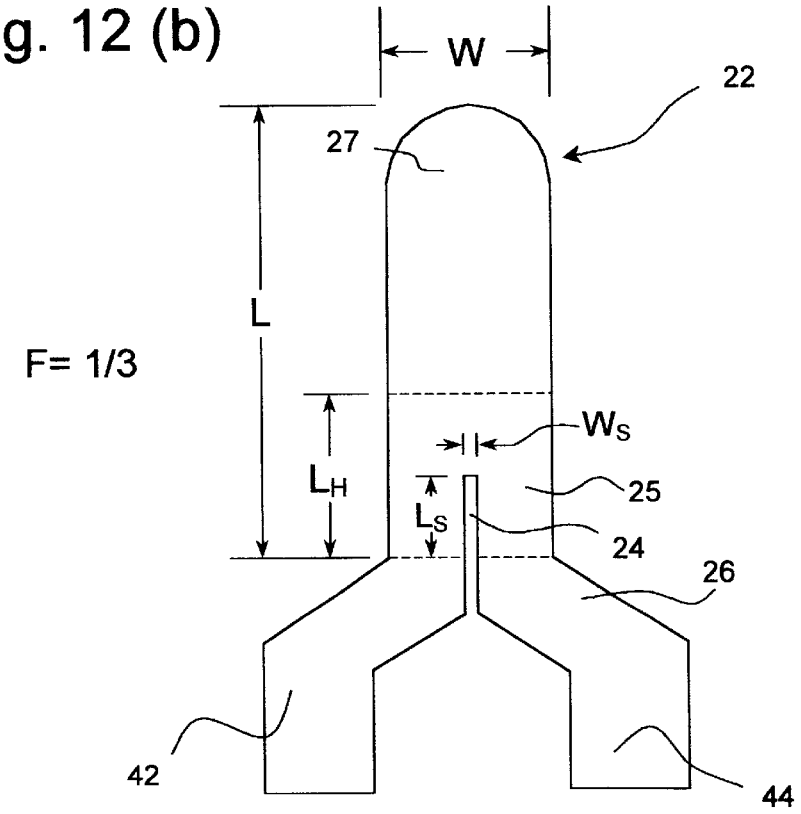

FIG. 12 is a plan view of first layer 22 illustrating dimensional relationships which are helpful in understanding the present inventions. First layer 22 is shown formed into the three portions discussed previously with respect to FIG. 11*b*. Anchored end portion 26, uniform resistor portion 25, and free end portion 27. Uniform heating will occur in uniform resistor portion 25 when an electrical current is passed between input pads 42 and 44. This uniform resistive heating causes the deflection of the cantilevered element 20 as illustrated in FIG. 10. Some significant resistive heating may occur in the anchor end portion 26. Such anchor end resistive heating is wasted energy and is preferably minimized by increasing the cross section area of the first layer 22 material and shortening current path lengths as much as possible in the anchor end portion 26. Very little resistive heating will occur in free end portion 27 as the current path will be substantially confined to the uniform resistor portion 25.

In FIG. 12, the uniform resistor portion 25 is formed by removing first layer 22 material in a central slot 24 having a length $L_S$ extending from the anchor location 14. Central slot 24 has an average width of $W_S$. In order to avoid hot spots of resistive heating, the central slot 24 is preferably formed with uniform dimensions along length $L_S$. For reasons of mechanical strength and thermal cycling efficiency, it is also desirable that the width $W_S$ of central slot 24 be made as narrow as is feasible consistent with defining a current path of uniform resistance. In some preferred embodiments of the present invention, the second layer 23 material is overlaid on the previously patterned first layer 22 material. To facilitate void free coverage of first layer 22 by second layer 23 down into central slot 24, central slot 24 may be formed with side walls tapering from bottom to top. Preferably central slot 24 is formed to an average width $W_S$ which is less than three times the thickness $h_1$ of first layer 22, i. e. $W_S<3h_1$. Coverage of features in first layer 22 having aspect ratios of height to width of 1:3 is within the capability of MEMS fabrication process methods.

Uniform resistor portion 25 is illustrated in FIG. 12 to extend to a length $L_H$ which is longer than central slot 24 length $L_S$. The electrical current path through the uniform resistor portion 25 will extend outward from the end of central slot 24 to a distance approximately equal to the width of the straight arm portions of the current path. The straight arm portions of the current path are approximately as wide as ½ W, where W is the width of the uniform resistor portion of the first layer 22 and the central slot width $W_S$ is small compared to W, $W_S<<W$. Thus, for the geometries illustrated in FIG. 12, $L_H \approx L_S + \frac{1}{2} W$.

It is useful to analyze first layer 22 designs in terms of the fractional length, F, of the uniform resistor portion $L_H$ as compared to the extended length L of the cantilevered element 20, where $F=L_H/L$. In order to select an optimized design for first layer 22, it is useful to calculate the peak temperature, ΔT, needed to achieve a desired deflection, D, of the free end 27 of the cantilevered element 20 as a function of the fractional length, F. ΔT is measured as the temperature increase above the base or ambient operating temperature. It is also useful to examine the amount of input energy, ΔQ, needed to achieve a desired deflection, D, as a function of the fractional heater length, F.

FIG. 12*a* illustrates a first layer 22 design wherein the fractional heater length F=⅔. FIG. 12*b* illustrates a design having F=⅓.

Figure 13:
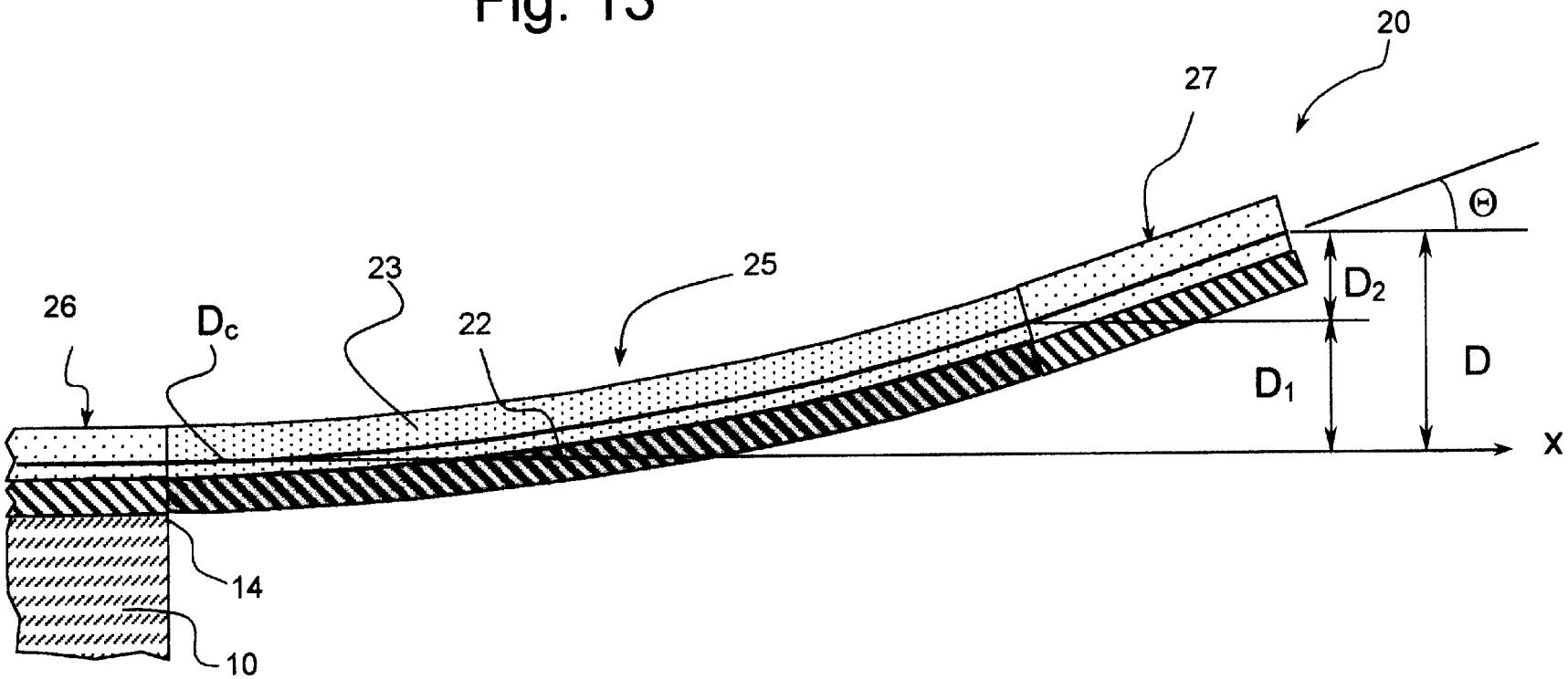
FIG. 13 is a diagram illustrating geometrical quantities used to analyze preferred embodiments of the present inventions.

The present inventions may be understood by a geometrical analysis of the deflection of cantilevered element 20 when a portion is heated uniformly causing bending. FIG. 13 illustrates an idealized cantilevered element 20, the free end 27 of which has been deflected an amount D. The deflection D is caused by an elongation of a uniform resistor portion 25, extending a length $L_H$ from an anchor location 14 of base element 10. The cantilevered element 20 has an extended length, L, of which the heated portion length, $L_H$, is a fraction, $L_H<L$. When uniform resistor portion 25 is heated, the first layer 22 extends an amount $\Delta L_H$ relative to the second layer 23 (see FIG. 4).

The mismatch of length between first layer 22 and second layer 23 will occur over a thickness through the layers. For the purpose of understanding the present inventions, it is sufficient to analyze the heated uniform resistor portion 25 as a beam formed into a parabolic shape by the stresses of the thermal expansion mismatch $\Delta L_H$ between layers 22 and 23.

In FIG. 13, the shape of the cantilevered element 20 is shown for the case where a uniform resistor portion 25 having a length $L_H$ is heated to have a temperature ΔT above an ambient or base operating temperature, $T_{base}$. The heated portion will be formed into a parabolic arc shape as indicated in FIG. 13. The unheated free end portion 27 of cantilevered element 20 extends from the end of the uniform resistor portion 25 as a straight segment tangent to the parabolic arc. The angle Θ of free end portion 27 can be found by evaluating the slope of the parabolic arc shape at the distance $x=L_H$. The total deflection D of free end portion 27 is the sum of a deflection component $D_1$ arising from the heated uniform resistor portion 25 and a deflection component $D_2$ arising from the angular extension of the unheated portion:

$$D=D_1+D_2. \tag{1}$$

The shape of the heated portion of cantilevered element 20 is calculated by finding the mechanical centerline $D_c(x)$ as a function of the distance x from the fixed point at anchor location 14. The mechanical centerline is indicated by the line $D_c$ in FIG. 13. The equation for the mechanical centerline $D_c(x)$ of a two-layer beam, having unequal thermal expansion coefficients, and in equilibrium at a temperature ΔT above a base temperature at which the beam is flat, is as follows:

$$D_c(x)=c\Delta T x^2/2. \tag{2}$$

Where, $$c=\frac{1}{G}\left\{\frac{E_1 h_1^2(a-a_1)}{2(1-\sigma_1^2)}+\frac{E_2[(h_1+h_2)^2-h_1^2](a-a_2)}{2(1-\sigma_2^2)}\right\}, \tag{3}$$

$$a=\frac{\dfrac{E_1 a_1 h_1}{1-\sigma_1}+\dfrac{E_2 a_2 h_2}{1-\sigma_2}}{\dfrac{E_1 h_1}{1-\sigma_1}+\dfrac{E_2 h_2}{1-\sigma_2}}, \tag{4}$$

$$G=\frac{E_1[(h_1-y_c)^3+y_c^3]}{3(1-\sigma_1^2)}+\frac{E_2[(h_1+h_2-y_c)^3-(h_1-y_c)^3]}{3(1-\sigma_2^2)}, \tag{5}$$

-continued $$y_c = \frac{\frac{E_1 h_1^2}{2(1-\sigma_1^2)} + \frac{E_2[(h_1+h_2)^2 - h_1^2]}{2(1-\sigma_2^2)}}{\frac{E_1 h_1}{1-\sigma_1^2} + \frac{E_2 h_2}{1-\sigma_2^2}}, \quad (6)$$

and $E_j$, $h_j$ and $\sigma_j$ are the Young's modulus, the thickness, and the Poisson's ratio of the $j^{th}$ layer (j=1,2). The term G is referred to as the flexural rigidity. The terms $\alpha_1$ and $\alpha_2$ are the coefficients of thermal expansion of the first layer and the second layer respectively. The important quantity ($c\Delta T$) is termed the thermal moment of the two-layer structure.

Deflection component $D_1$ is found by evaluating Equation 2 for $x=L_H$:

$$D_1=D_c(L_H)=c\Delta T L_H^2/2. \quad (7)$$

The end of the beam extends in a straight-line tangent to the parabola at the point, $x=L_H$. The slope of this straight line extension, tan Θ, is the derivative of Equation 2, evaluated at $x=L_H$. Therefore:

$$D_2=(L-L_H)\sin\Theta, \quad (8)$$

$$\tan\Theta=c\Delta T L_H, \quad (9)$$

$$D_2\approx(L-L_H)\tan\Theta, \quad (10)$$

$$D_2 c\Delta T L_H(L-L). \quad (11)$$

Because Θ is small, sin Θ≈tan Θ to second order in Θ. Thus, substituting Equations 7 and 11 into Equation 2 the total deflection D is found:

$$D\approx c\Delta T(2L_H L-L_H^2)/2. \quad (12)$$

In order to understand the benefits and consequences of forming fractional length uniform resistor portion 25, it is useful to compare to a nominal design case. For the nominal design case, it is assumed that the application of the thermal actuator requires that the deflection D be a nominal amount $D_0$. Further, it is determined that, if the full cantilevered element 20 length L is resistively heated, $L_H$=L, F=1.0, then a temperature difference of $\Delta T_0$ must be established by an electrical pulse. That is, the nominal deflection for a full length heater is $$D_0\approx cL^2\Delta T_0/2. \quad (13)$$

Deflection Equation 12 may be formulated in terms of the fractional heater length, $F=L_H/L$, and the above nominal deflection $D_0$, as follows:

$$D\approx F(2-F)D_0\Delta T/\Delta T_0 \quad (14)$$

Equation 14 shows the relationship between the peak temperature that must be reached in order to achieve an amount of deflection when the heated portion of the cantilevered element is a fraction F of the overall extended length L. The trade-off between peak temperature and fractional heater length may be understood by examining Equation 14 for the case where the deflection D is set equal to a constant nominal amount, $D_0$, needed by the device application of the thermal actuator:

$$\Delta T\approx\Delta T_0/F(2-F) \quad (15)$$

Figure 14:
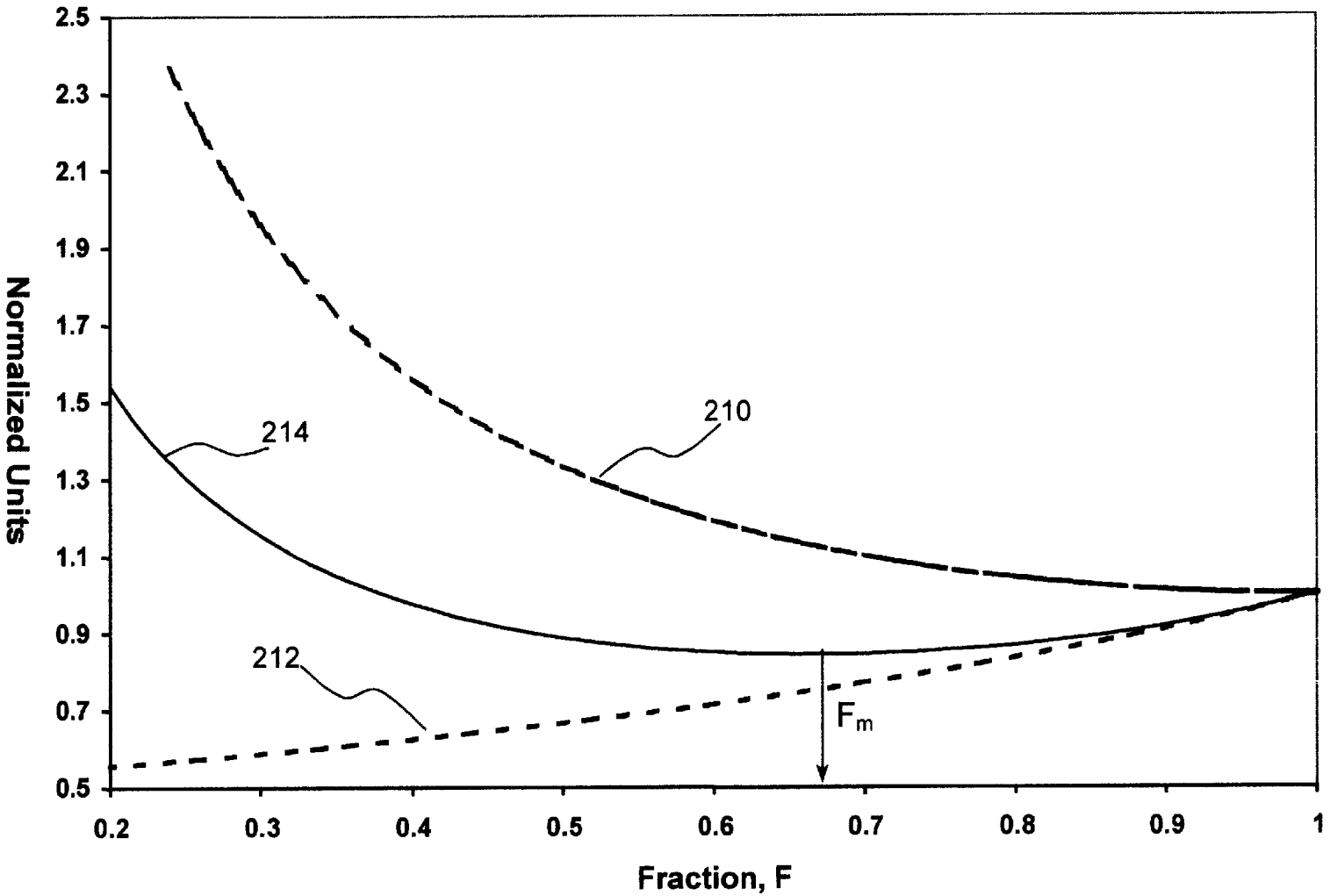
FIG. 14 is a plot of thermal actuator performance attributes of the present inventions.

Equation 15 is plotted as curve 210 in FIG. 14. ΔT is plotted in units of $\Delta T_0$. This relationship shows that as the fractional heater length F is reduced from F=1, the amount of temperature difference required to achieve the desired cantilever element deflection, $D_0$, increases. For a fractional heater length F=⅓ as is illustrated in FIG. 12*b*, the temperature difference must be approximately 70% greater than for the 100% heater length nominal case. For the F=⅔ case illustrated in FIG. 12*a*, ΔT must be approximately 20% greater than $\Delta T_0$. Hence, it can be understood from Equation 15, and curve 210 in FIG. 14, that reducing the heated portion of the cantilevered element comes at the expense of supporting higher peak temperatures in the device. The materials of the thermal actuator and any fluids used with the actuator will have failure modes that limit the practical peak temperatures than can be used. When attempting to reduce the fractional heater length to a minimum, at some point, an unreliable level of the peak temperature will be required and further heater length reduction will be impractical.

An important benefit of reducing the heated portion of a cantilevered element thermal actuator arises from the energy reduction that may be realized. The pulse of energy added to the uniform resistor portion 25, ΔQ, raises the temperature by ΔT. That is, to first order:

$$\Delta Q=m_1 C_1\Delta T, \quad (16)$$

$$m_1=\rho_1 h_1 WFL. \quad (17)$$

where $m_1$, is the mass of the uniform resistor portion 25 of first layer 22. $\rho_1$ is the density of the electrically resistive material used to construct first layer 22. $h_1$, W, and FL are the thickness, width and length of the volume of first layer 22 material that is initially heated by the electrical energy pulse. $C_1$, is the specific heat of the first layer 22 electrically resistive material.

The amount of energy needed for the nominal design where $L_H$=L, F=1.0, is then:

$$\Delta Q_0=C_1\rho_1 h_1 WL\Delta T_0. \quad (18)$$

Equation (18) may be expressed in normalized form as follows:

$$\Delta Q\approx F\Delta Q_0\Delta T/\Delta T_0, \quad (19)$$

$$\Delta Q\approx\Delta Q_0/(2-F). \quad (20)$$

Equation 20 describes the tradeoff between energy input and fractional heater length. The input pulse energy ΔQ normalized by the nominal input pulse energy $\Delta Q_0$ is plotted as curve 212 in FIG. 14. Curve 212 shows that the energy needed declines as the fractional heater length is decreased. Even though the material in the heated portion must be raised to a higher temperature difference, ΔT, less material is heated. Therefore, a net saving of input pulse energy can be realized by reducing the fractional heater length. For example, the F=⅔ heater configuration illustrated in FIG. 12*a* requires 25% less energy than the nominal case of F=1. The F=⅓ heater configuration illustrated in FIG. 12*b* requires 40% less energy than the nominal case.

Operating a thermal actuator of fractional heater length according to the present invention allows less input energy to be used to accomplish the needed amount of deflection. Less energy use has many system advantages including power supply savings, driver circuitry expense, device size and packaging advantages.

For thermally actuated devices such as liquid drop emitters, the reduced input energy also translates into improved drop repetition frequency. The cool down period of a thermal actuator is often the rate limiting physical effect governing drop repetition frequency. Using less energy to cause an actuation reduces the time required to dissipate the input heat energy, returning to a nominal actuator position.

Using a fractional length uniform resistor portion 25 is additionally beneficial in that the major portion of the input heat energy resides closer to the substrate base element 10, thereby allowing quicker heat conduction from the cantilevered element 20 to the base element 10 at the end of each actuation. The time constant $\tau$ for heat conduction from the cantilevered element may be understood to first order by a using a one-dimensional analysis of the heat conduction. Such an analysis finds that the time constant is proportional to the square of the heat flow path length. Thus, the heat conduction time constant for a uniform resistor portion 25 of length $L_H$=FL will be proportional to $F^2$:

$$\tau_F \propto F^2 \tau_0, \tag{21}$$

Where $\tau_0$ is the heat conduction time constant for the nominal case of a full length heater. Hence, the required time for the actuator cool down period can be improved significantly by reducing the fractional length of the uniform resistor portion 25. Reduction in the conduction heat transfer time constant, which occurs proportionally to $F^2$, is an important system benefit when using of fractional length heater thermal actuators according to the present inventions.

By reducing the input energy needed per actuation and improving the speed of heat transfer via conduction, a lower temperature baseline may be maintained when repeated actuations are needed. With lower input energy, multiple pulses may be supported, allowing the beginning temperature to rise between pulses, but still maintain the device temperature below some upper failure limit.

Curves 210 and 212 in FIG. 14 illustrate that there is a system trade-off involved when choosing a reduced heater length to cause the required amount of deflection. Shorter heater lengths allow reduced energy input but require higher peak temperatures which may cause reliability problems. In many systems, the percentage savings in energy and the percentage increase in temperature are approximately equal in the system impact in terms of cost and reliability. An optimization of these two quantities may be understood by forming a product of the two. A desirable energy reduction in $\Delta Q$ is calibrated by the undesirable increase in required temperature above the base operating temperature, $\Delta T$.

A system optimization function, S, may be formed as a function of fractional heater length, F, from Equations 15 and 20 as follows:

$$S(F)=\Delta Q(F)\times\Delta T(F), \tag{22}$$

$$S(F)=\Delta Q_0 \Delta T_0/F(2-F)^2. \tag{23}$$

The system optimization function S of Equation 23 is plotted as curve 214 in FIG. 14. It has been normalized to have units of $\Delta Q_0 \Delta T_0$. It can be seen from curve 214 that the system optimization, S, improves to a minimum, $S_m$, and then increases as the required $\Delta T$ becomes large compared to the savings in $\Delta Q$. The minimum in the system optimization function, $S_m$, is found as the value of F for which the derivative of S is zero:

$$dS/dF=(3F-2)/F^2(2-F)^3. \tag{24}$$

dS/dF=0, when $F=F_m=2/3$. Therefore, choosing F=⅔ optimizes the design for energy savings in percentage terms as calibrated by an increase in the required temperature excursion above the base operating temperature, also in percentage terms.

It may be understood from the relations plotted in FIG. 14 that the thermal actuator system benefits from energy reduction at a faster rate than it loses due to peak temperature increases, when 1>F>⅔. Below F=⅔, the rate of increase in peak temperature is faster than the rate of decline in input pulse energy. At F=½, the percentage of peak temperature increase, 33%, is equal to the percentage of pulse energy reduction, also 33%.

For F<½, the percentage amount of peak temperature increase is larger than the percentage of pulse energy reduction. The amount of required temperature increase, in percentage terms, is double that of the nominal case when F~0.3. The operating temperature requirement increases rapidly below this fractional length, nearly tripling for F~0.2. From FIG. 14 and Equations 15 and 20, it may be understood that for F<0.3, the energy savings are increasing only a few percentage points while the required temperature is doubling and tripling. Such large increases in operating temperature are severely limiting to the materials which may be used form and assemble the thermal actuator and also may severely limit the compositions of liquids which may necessarily contact the thermal actuator in liquid drop emitter embodiments of the present inventions. Therefore, according to the present inventions, fractional heater lengths are selected such that F>0.3 in order to avoid device and system reliability failures caused by excessive operating temperatures.

A system design which balances energy reduction with peak temperature increase is found by selecting a fractional heater length in the range: 0.3 L<$L_H$<0.7 L. This range is defined at the upper end by the fractional length which optimizes the gain in energy savings while minimizing the increase in operating temperature. The range is defined on the lower end by the point at which the operating temperature increase has doubled over the full length heater case and further gains in energy reduction are very small compared to the rapid increases in required operating temperatures.

The cantilevered elements discussed heretofore used an electrically resistive material first layer 22 which extended for substantially the full extended length of the cantilevered element 20. This configuration is desirable for reasons of mechanical strength and heat transfer during the cooling phase of the actuation cycle. However, the present invention may also be practiced whereby reduced heater length is configured as a reduced length of the electrically resistive layer 22. This alternative embodiment is illustrated as FIG. 15*b*. The configuration of FIG. 15*b* has a heated portion 25 of the cantilevered element 20 which is truncated so that only the support second layer 23 forms the free end portion 27. The heretofore discussed configuration with a substantially full length layer of electrically resistive material is shown for comparison as FIG. 15*a*.

Figure 15A:
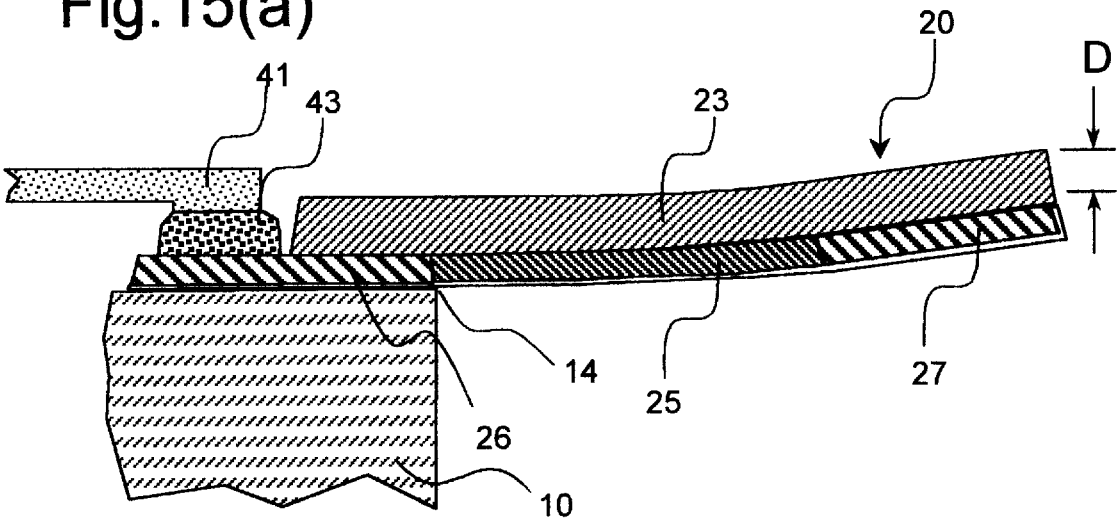
FIG. 15 is a side view illustrating a comparison between two preferred embodiments of the present invention.
Figure 15B:
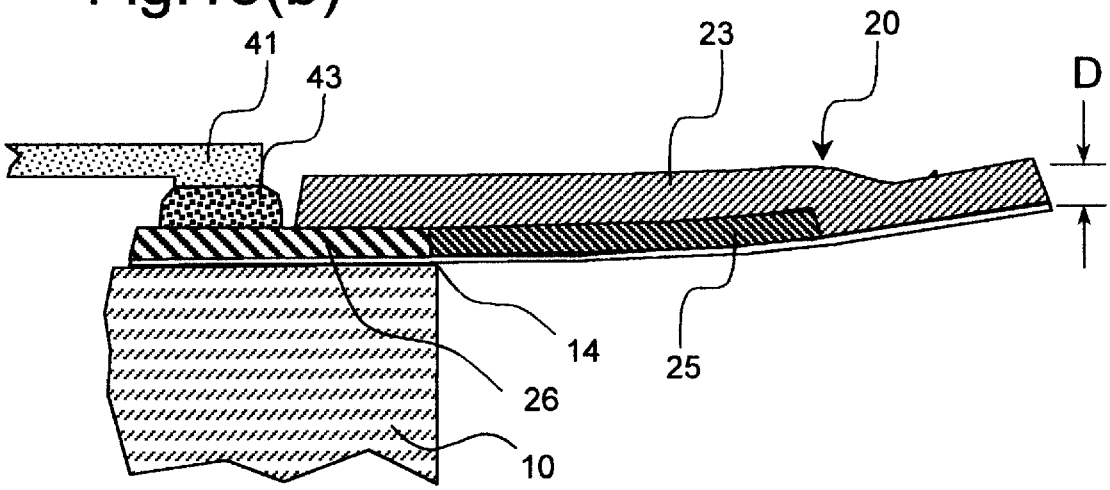

The two configurations illustrated in FIG. 15 are expected to exhibit approximately the same amount of deflection D since they have the same values for all of the relevant parameters in Equations 1–14. However, the configuration of FIG. 15*b* will not cool as rapidly when used to displace a fluid nor can heat from free end portion 27 be easily conducted away from the cantilevered element. Also, the strength of the free end configuration of FIG. 15*b* will be less than that of configuration FIG. 15*a*. This weakness is potentially a source of actuator failure due to breakage in a fluid drop emitter device or other application where the free end moves a mass of liquid or other material. A partial length heater material configuration as illustrated in FIG. 15*b* is a viable embodiment of the present invention for applications where free end tip mechanical weakness, and slower actuator repetition times, are acceptable.

While much of the foregoing description was directed to the configuration and operation of a single thermal actuator or drop emitter, it should be understood that the present invention is applicable to forming arrays and assemblies of multiple thermal actuators and drop emitter units. Also it should be understood that thermal actuator devices according to the present invention may be fabricated concurrently with other electronic components and circuits, or formed on the same substrate before or after the fabrication of electronic components and circuits.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

PARTS LIST

10 substrate base element
12 liquid chamber
13 gap between cantilevered element and chamber wall
14 cantilevered element anchor location
15 thermal actuator
16 liquid chamber curved wall portion
20 cantilevered element
21 passivation layer
22 first layer
23 second layer
24 central slot forming uniform resistor portion
25 cantilevered element uniform resistor portion
26 cantilevered element anchor end portion
27 cantilevered element free end portion
28 liquid chamber structure, walls and cover
29 passivation layer
30 nozzle
41 TAB lead
42 electrical input pad
43 solder bump
44 electrical input pad
50 drop
60 working fluid
80 support structure
100 ink jet printhead
110 drop emitter unit
200 electrical pulse source
300 controller
400 image data source
500 receiver

What is claimed is:

1. A thermal actuator for a micro-electromechanical device comprising:

(a) a base element;

(b) a cantilevered element extending a length L from the base element and residing at a first position, the cantilevered element including a first layer constructed of an electrically resistive material patterned to have a uniform resistor portion extending a length $L_H$ from the base element, wherein $0.3L \leqq L_H \leqq 0.7L$, and a second layer constructed of a dielectric material having a low coefficient of thermal expansion and attached to the first layer; and (c) a pair of electrodes connected to the uniform resistor portion to apply an electrical pulse to cause resistive heating, resulting in a thermal expansion of the uniform resistor portion of the first layer relative to the second layer and deflection of the cantilevered element to a second position, followed by restoration of the cantilevered element to the first position as heat transfers from the uniform resistor portion and the temperature thereof decreases.

2. The thermal actuator of claim 1 wherein the first layer extends from the base element to substantially the length L of the cantilevered element.

3. The thermal actuator of claim 1 wherein the electrically resistive material is titanium aluminide.

4. The thermal actuator of claim 1 wherein the uniform resistor portion is formed by removing electrically resistive material in the first layer leaving a remaining resistor pattern and the second layer is formed over the first layer covering the remaining resistor pattern.

5. The thermal actuator of claim 1 wherein the first layer has a thickness h and the uniform resistor portion is formed by removing electrically resistive material in an elongated central slot through the first layer, the elongated central slot having a uniform slot width $W_S$, wherein $W_S < 3\ h_1$.

6. The thermal actuator of claim 5 wherein the uniform resistor portion has a width W and the elongated central slot extends from the base element to a length $L_S$ approximately equal to $(L_H - \frac{1}{2} W)$.

7. The thermal actuator of claim 1 wherein $L_H$ is approximately equal to $\frac{2}{3}$ L.

8. A thermal actuator for a micro-electromechanical device comprising:

(a) a base element;

(b) a cantilevered element extending a length L from the base element and residing at a first position, the cantilevered element including a first layer constructed of titanium aluminide which extends substantially the length L of the cantilevered element and is patterned to have a uniform resistor portion extending a length $L_H$ from the base element, wherein $0.3L \leqq L_H \leqq 0.7L$, and a second layer constructed of a dielectric material having a low coefficient of thermal expansion and attached to the first layer; and (c) a pair of electrodes connected to the uniform resistor portion to apply an electrical pulse to cause resistive heating, resulting in a thermal expansion of the uniform resistor portion of the first layer relative to the second layer and deflection of the cantilevered element to a second position, followed by restoration of the cantilevered element to the first position as heat transfers from the uniform resistor portion and the temperature thereof decreases.

9. The thermal actuator of claim 8 wherein the uniform resistor portion is formed by removing titanium aluminide material in the first layer leaving a remaining resistor pattern and the second layer is formed over the first layer covering the remaining resistor pattern.

10. The thermal actuator of claim 8 wherein the first layer has a thickness $h_1$ and the uniform resistor portion is formed by removing the titanium aluminide material in an elongated central slot through the first layer, the elongated central slot having a uniform slot width $W_S$, wherein $W_S < 3\ h_1$.

11. The thermal actuator of claim 10 wherein the uniform resistor portion has a width W and the elongated central slot extends from the base element to a length $L_S$ approximately equal to $(L_H - \frac{1}{2} W)$.

12. The thermal actuator of claim 9 wherein $L_H$ is approximately equal to $\frac{2}{3}$ L.

13. A liquid drop emitter comprising:

(a) a chamber, formed in a substrate, filled with a liquid and having a nozzle for emitting drops of the liquid;

(b) a thermal actuator having a cantilevered element extending a length L from a wall of the chamber and a free end residing in a first position proximate to the nozzle, the cantilevered element including a first layer constructed of an electrically resistive material patterned to have a uniform resistor portion extending a length $L_H$ from the wall of the chamber, wherein $0.3L \leqq L_H < 0.7L$, and a second layer constructed of a dielectric material having a low coefficient of thermal expansion and attached to the first layer; and (c) a pair of electrodes connected to the uniform resistor portion to apply an electrical pulse to cause resistive heating, resulting in a thermal expansion of the uniform resistor portion of the first layer relative to the second layer and rapid deflection of the cantilevered element, ejecting liquid at the nozzle, followed by restoration of the cantilevered element to the first position as heat transfers from the uniform resistor portion and the temperature thereof decreases.

14. The liquid drop emitter of claim 13 wherein the liquid drop emitter is a drop-on-demand ink jet printhead and the liquid is an ink for printing image data.

15. The liquid drop emitter of claim 13 wherein the first layer extends from the base element to substantially the length L of the cantilevered element.

16. The liquid drop emitter of claim 13 wherein the electrically resistive material is titanium aluminide.

17. The liquid drop emitter of claim 13 wherein the uniform resistor portion is formed by removing electrically resistive material in the first layer leaving a remaining resistor pattern and the second layer is formed over the first layer covering the remaining resistor pattern.

18. The liquid drop emitter of claim 13 wherein the first layer has a thickness $h_1$ and the uniform resistor portion is formed by removing electrically resistive material in an elongated central slot through the first layer, the elongated central slot having a uniform slot width $W_S$, wherein $W_S < 3\ h_1$.

19. The liquid drop emitter of claim 18 wherein the uniform resistor portion has a width W and the elongated central slot extends from the base element to a length $L_S$ approximately equal to $(L_H - \frac{1}{2} W)$.

20. The liquid drop emitter of claim 13 wherein $L_H$ is approximately equal to $\frac{2}{3}$ L.

21. A liquid drop emitter comprising:

(a) a chamber, formed in a substrate, filled with a liquid and having a nozzle for emitting drops of the liquid;

(b) a thermal actuator having a cantilevered element extending a length L from a wall of the chamber and a free end residing in a first position proximate to the nozzle, the cantilevered element including a first layer constructed of titanium aluminide which extends substantially the length L of the cantilevered element and is patterned to have a uniform resistor portion extending a length $L_H$ from the wall of the chamber, wherein $3.0L \leqq L_H \leqq 0.7L$, and a second layer constructed of a dielectric material having a low coefficient of thermal expansion and attached to the first layer; and (c) a pair of electrodes connected to the uniform resistor portion to apply an electrical pulse to cause resistive heating, resulting in a thermal expansion of the uniform resistor portion of the first layer relative to the second layer and rapid deflection of the cantilevered element, ejecting liquid at the nozzle, followed by restoration of the cantilevered element to the first position as heat transfers from the uniform resistor portion and the temperature thereof decreases.

22. The liquid drop emitter of claim 21 wherein the liquid drop emitter is a drop-on-demand ink jet printhead and the liquid is an ink for printing image data.

23. The liquid drop emitter of claim 21 wherein the uniform resistor potion is formed by removing titanium aluminide material in the first layer leaving a remaining resistor pattern and the second layer is formed over the first layer covering the remaining resistor pattern.

24. The liquid drop emitter of claim 21 wherein the first layer has a thickness $h_1$ and the uniform resistor portion is formed by removing titanium aluminide material in an elongated central slot through the first layer, the elongated central slot having a uniform slot width $W_S$, wherein $W_S < 3\ h_1$.

25. The liquid drop emitter of claim 24 wherein the uniform resistor portion has a width W and the elongated central slot extends from the base element to a length $L_S$ approximately equal to $(L_H - \frac{1}{2} W)$.

26. The liquid drop emitter of claim 21 wherein $L_H$ is approximately equal to $\frac{2}{3}$ L.

* * * * *

UNITED STATES PATENT AND TRADEMARK OFFICE

CERTIFICATE OF CORRECTION

PATENT NO. : 6,631,979 B2
DATED : October 14, 2003
INVENTOR(S) : Antonio Cabal et al.

It is certified that error appears in the above-identified patent and that said Letters Patent is hereby corrected as shown below:

Title page,
Item [57], ABSTRACT,
Line 8, change "L" to -- $L_H$ --

Column 16,
Line 17, change "$h$" to -- $h_1$ --

Column 18,
Line 12, change "3.0L" to -- 0.3L --

Signed and Sealed this

Fifteenth Day of February, 2005

JON W. DUDAS
*Director of the United States Patent and Trademark Office*